US006533400B1

(12) United States Patent
Kudo et al.

(10) Patent No.: US 6,533,400 B1
(45) Date of Patent: Mar. 18, 2003

(54) LIQUID DISCHARGING METHOD

(75) Inventors: Kiyomitsu Kudo, Kawasaki (JP); Hiroshi Sugitani, Machida (JP); Masanori Takenouchi, Yokohama (JP); Masami Ikeda, Tokyo (JP); Masahiko Kubota, Tokyo (JP); Ryoji Inoue, Kawasaki (JP); Takashi Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/652,664

(22) Filed: Aug. 31, 2000

(30) Foreign Application Priority Data

Sep. 3, 1999 (JP) ..... 11-250936

(51) Int. Cl.[7] ..... B41J 2/05
(52) U.S. Cl. ..... 347/63; 347/65
(58) Field of Search ..... 347/65–67, 63

(56) References Cited

U.S. PATENT DOCUMENTS

| | | | | |
|---|---|---|---|---|
| 4,412,224 | A | 10/1983 | Sugitani | 347/65 |
| 4,417,251 | A | 11/1983 | Sugitani | 347/65 |
| 4,437,100 | A | 3/1984 | Sugitani et al. | 347/65 |
| 4,450,455 | A | 5/1984 | Sugitani et al. | 347/45 |
| 4,480,259 | A | 10/1984 | Kruger et al. | 347/63 |
| 4,496,960 | A | 1/1985 | Fischbeck | 347/68 |
| 4,509,063 | A | 4/1985 | Sugitani et al. | 347/65 |
| 4,521,787 | A | 6/1985 | Yokota et al. | 347/65 |
| 4,558,333 | A | 12/1985 | Sugitani et al. | 347/65 |
| 4,568,953 | A | 2/1986 | Aoki et al. | 347/65 |
| 4,609,427 | A | 9/1986 | Inamoto et al. | 216/27 |
| 4,611,219 | A | 9/1986 | Sugitani et al. | 347/40 |
| 4,646,110 | A | 2/1987 | Ikeda et al. | 347/15 |
| 4,666,823 | A | 5/1987 | Yokota et al. | 347/65 |
| 4,723,129 | A | 2/1988 | Endo et al. | 347/56 |
| 4,994,825 | A | 2/1991 | Saito et al. | 347/63 |
| 5,095,321 | A | 3/1992 | Saito et al. | 347/63 |
| 5,208,604 | A | 5/1993 | Wantanabe et al. | 347/47 |
| 5,262,802 | A | 11/1993 | Karita et al. | 347/87 |
| 5,278,585 | A | 1/1994 | Karz et al. | 347/65 |
| 5,389,957 | A | 2/1995 | Kimura et al. | 347/20 |
| 5,485,184 | A | 1/1996 | Nakagomi et al. | 347/63 |
| 5,821,962 | A | * 10/1998 | Kudo et al. | 347/65 |
| 5,940,957 | A | 8/1999 | Goto et al. | 29/611 |
| 6,007,187 | A | 12/1999 | Kashino et al. | 347/65 |
| 6,048,058 | A | 4/2000 | Kasamoto et al. | 347/94 |
| 6,062,680 | A | 5/2000 | Yoshihira et al. | 347/65 |
| 6,074,543 | A | 6/2000 | Yoshihira et al. | 205/75 |
| 6,109,734 | A | 8/2000 | Kashino et al. | 347/65 |

FOREIGN PATENT DOCUMENTS

| | | | |
|---|---|---|---|
| EP | 0160463 | 11/1985 | B41J/3/04 |
| EP | 0 436047 | 7/1991 | B41J/2/055 |
| EP | 0 443 798 | 8/1991 | B41J/2/14 |

(List continued on next page.)

*Primary Examiner*—John Barlow
*Assistant Examiner*—Juanita Stephen
(74) *Attorney, Agent, or Firm*—Fitzpatrick, Cella, Harper & Scinto

(57) ABSTRACT

There is disclosed a liquid discharge head comprising: a plurality of discharge ports for discharging a liquid; a plurality of liquid flow paths whose one end portion always communicates with each of the discharge ports and which comprise a bubble generating area for generating a bubble in the liquid; bubble generating means for generating an energy to generate and grow the bubble; a plurality of liquid supply ports, disposed in the liquid flow paths, for communicating with a common liquid supply chamber; and a movable member having a free end supported at a slight gap with respect to the liquid flow path of the liquid supply port, so that recording of a high quality level image is achieved at a high speed. When a volume of a liquid droplet discharged from the discharge port is Vd, and during discharge of the liquid from the discharge port, a drawing volume from the discharge port to a liquid surface retracted to maximum into the liquid flow path is Vm, a relation of Vd>Vm is established. Therefore, meniscus returns fast, and a refill frequency can be enhanced.

3 Claims, 24 Drawing Sheets

FOREIGN PATENT DOCUMENTS

| | | | |
|---|---|---|---|
| EP | 0 764 528 | 3/1997 | ..... B41J/2/05 |
| EP | 0 816 088 | 1/1998 | ..... B41J/2/14 |
| EP | 0 976 562 | 2/2000 | ..... B41J/2/14 |
| JP | 55-81172 | 6/1980 | ..... B41J/3/04 |
| JP | 61-69467 | 4/1986 | ..... B41J/3/04 |
| JP | 61-110557 | 5/1986 | ..... B41J/3/04 |
| JP | 62-156969 | 7/1987 | ..... B41J/3/04 |
| JP | 63-197652 | 8/1988 | ..... B41J/3/04 |
| JP | 3-81155 | 4/1991 | ..... B41J/2/05 |
| JP | 04-118248 | 4/1992 | ..... B41J/2/05 |
| JP | 5-124189 | 5/1993 | ..... B41J/2/05 |
| JP | 05-229122 | 9/1993 | ..... B41J/2/05 |
| JP | 6-87214 | 3/1994 | ..... B41J/2/05 |
| JP | 63-28654 | 2/1998 | ..... B41J/3/04 |
| JP | 63-199972 | 8/1998 | ..... B41J/3/04 |

* cited by examiner

LIQUID DISCHARGING METHOD

BACKGROUND OF THE INVENTION

1. Field of the Invention

The present invention relates to a liquid discharge head for applying a thermal energy to a liquid to generate a bubble and discharge the liquid, a method of manufacturing the liquid discharge head, and a liquid discharge apparatus using the liquid discharge head.

Moreover, the present invention can be applied to apparatuses for performing recording on recording media such as paper, thread, fiber, cloth, leather, metal, plastic, glass, wood, ceramic, and the like, such as a printer, a copying machine, a facsimile machine provided with a communication system, and a word processor provided with a printer section, and further to an industrial recording apparatus combined with various processing apparatuses in a composite manner.

Additionally, "recording" in the present invention means not only that a character image, a diagram image or another meaningful image is given to the recording medium, but also that a pattern image or another meaningless image is given.

2. Related Background Art

In conventional recording apparatuses such as a printer, an ink jet recording method, a so-called bubble jet recording method is known which comprises applying heat or another energy to a liquid ink in a flow path to generate a bubble, discharging the ink from a discharge port by an action force based on a steep volume change with the bubble, and attaching the ink to a recording medium to form an image. In a recording apparatus using the bubble jet recording method, as disclosed in U.S. Pat. No. 4,723,129 or the like, the discharge port for discharging the ink, the flow path connected to the discharge port, and an electrothermal converting element as energy generating means, disposed in the flow path, for discharging the ink are usually arranged.

According to the recording method, a high quality level image can be recorded with a high speed and a low noise, and the discharge ports for discharging the ink can be arranged with a high density in a head to perform the recording method, which provides many advantages that a high-resolution recorded image and further a color image can easily be obtained with a small-sized apparatus. Therefore, in recent years the bubble jet recording method has been utilized in many office apparatuses such as a printer, a copying machine, and a facsimile machine, and further in industrial systems such as a textile printing machine.

Various demands have been raised with utilization of such bubble jet technique in products of various fields, and for example, there are proposed drive conditions for providing a liquid discharge method to perform a satisfactory ink discharge with a fast ink discharge speed based on a stable bubble generation in order to obtain a high quality image, or improvement of a flow path configuration to obtain a liquid discharge head fast in refill speed of a discharged liquid into a liquid flow path from a viewpoint of high-speed recording.

Above all, in a head for generating the bubble in a nozzle and discharging the liquid with bubble growth, the bubble growth in a direction opposite to the discharge port and a generated liquid flow are known as factors for deteriorating discharge energy efficiency and refill property, and the invention provided with a structure for enhancing the discharge energy efficiency and refill property is proposed in European Patent Application Laid-Open No. EP0436047A1.

In the invention described in the publication, a first valve, disposed between the vicinity of the discharge port and a bubble generator, for shutting them off, and a second valve, disposed between the bubble generator and an ink supply section, for completely shutting them off are alternately opened/closed (FIGS. 4 to 9 of EP436047A1). For example, in an example of FIG. 7 of the publication, as shown in FIG. 23, a heat generating member 110 is disposed substantially in the middle of an ink flow path 112 between an ink tank 116 and a nozzle 115 on a substrate 125 for forming an inner wall of the ink flow path 112. The heat generating member 110 lies in a division 120 with an entirely closed periphery inside the ink flow path 112. The ink flow path 112 is constituted of the substrate 125, thin films 123, 126 directly laminated on the substrate 125, and ligulate pieces 113, 130 as closing members. The opened ligulate piece is shown by a broken line in FIG. 23. Another thin film 123 extending in a plane parallel to the substrate 125 and terminating in a stopper 124 shuts off on the ink flow path 112. When the bubble is generated in the ink, a free end of the ligulate piece 130 in a nozzle area closely attached to the stopper 126 in a stationary state is displaced upward, and the ink liquid is discharged via the ink flow path 112 and nozzle 115 from the division 120. In this case, since the ligulate piece 113 disposed in an area of the ink tank 116 closely abuts on the stopper 124 in the stationary state, the ink liquid in the division 120 fails to go toward the ink layer 116. When the bubble in the ink vanishes, the ligulate piece 130 is displaced downward to again abut on the stopper 126. Moreover, the ligulate piece 113 falls down in the ink division 120, and accordingly the ink liquid flows into the division 120.

SUMMARY OF THE INVENTION

In the invention described in EP0436047A1, however, each of three chambers of the vicinity of the discharge port, bubble generator and ink supply section is divided into two, the ink following a liquid droplet trails long during discharge, and the number of satellite dots considerably increases as compared with an ordinary discharge system for performing bubble growth, shrinkage, and bubble vanishing (it is assumed that an effect of meniscus retreat by the bubble vanishing cannot be used). Moreover, the valve on the side of the bubble discharge port causes much loss of discharge energy. Furthermore, during refill (during ink replenishment to the nozzle) the liquid is supplied to the bubble generator with bubble vanishing, but no liquid can be supplied to the vicinity of the discharge port until the next bubbling occurs, therefore a dispersion of discharged liquid droplet is large, further a discharge response frequency is remarkably small, and a practical level cannot be obtained.

In the present invention, there is proposed an invention for enhancing an inhibition efficiency of a bubble growth component in a direction opposite to a discharge port and contrarily for enhancing a discharge efficiency based on a new idea to find out an inventive method for satisfying a highly efficient refill property and a head constitution.

As a result of intensive researches, the present inventor et al. have found that in a nozzle structure of a liquid discharge head for generating a bubble in a linearly formed nozzle and discharging a liquid with bubble growth, a function of a special check valve inhibits the bubble growth in a (rearward) direction opposite to a discharge port, and a rearward discharge energy can effectively be utilized on a discharge port side. Additionally, it has been found that the special check valve function inhibits a rearward bubble growth component, an efficient refill property is provided, and a discharge response frequency can therefore be set to be considerably high.

Specifically, an object of the present invention is to establish an inventive discharge system (structure) for simultaneously enhancing discharge power and discharge frequency by a nozzle structure and discharge method using an inventive valve function and for achieving a high speed, high image quality head of a level which has not been heretofore achieved.

According to the present invention obtained in the process of the aforementioned research, there is provided a liquid discharge head comprising: a plurality of discharge ports for discharging a liquid; communicates with each of the discharge ports and which comprise a bubble generating area for generating a bubble in the liquid; bubble generating means for generating an energy to generate and grow the bubble; a plurality of liquid supply ports, disposed in the plurality of liquid flow paths, respectively, for communicating with a common liquid supply chamber; and a movable member having a free end supported at a slight gap with respect to the side of the liquid flow path of the liquid supply port. An area surrounded with at least a free end portion of the movable member and both side portions continued from the free end portion is larger than an opening area to the liquid flow path of the liquid supply port. A period when the movable member seals and substantially shuts off the opening area is provided from when a drive voltage is applied to the bubble generating means until a period of substantial isotropic growth of the entire bubble by the bubble generating means ends. After the period when the movable member seals and substantially shuts off the opening area, and while a portion of the bubble generated by the bubble generating means on the side of the discharge port grows, the movable member starts displacement on the side of the bubble generating means inside the liquid flow path, and liquid supply is enabled to the liquid flow path from the common liquid supply chamber. When a volume of a liquid droplet discharged from the discharge port is Vd, and during discharge of the liquid from the discharge port, a drawing volume from the discharge port to a liquid surface retracted to maximum into the liquid flow path is Vm, a relation of Vd>Vm is established.

The slight gap between the movable member and the liquid supply port is preferably about 10 $\mu$m or less.

A discharge direction of the liquid from the discharge port substantially crosses at right angles to a normal direction of a surface on which the bubble generating means is disposed, or the discharge port is supposedly disposed opposite to the bubble generating means.

Moreover, according to the present invention, there is provided a liquid discharge apparatus comprising: the aforementioned liquid discharge head; and recording medium conveying means for conveying a recording medium to receive the liquid discharged from the liquid discharge head. In this case, it is considered that an ink is discharged from the liquid discharge head, and attached to the recording medium to perform recording.

Further, according to the present invention, there is provided a liquid discharging method utilizing a liquid discharge head comprising:

a plurality of discharge ports for discharging a liquid;

a plurality of liquid flow paths whose one end portion always communicates with each of said discharge ports and which comprise a bubble generating area for generating a bubble in the liquid;

bubble generating means for generating an energy to generate and grow said bubble;

a plurality of liquid supply ports, disposed in said plurality of liquid flow paths, respectively, for communicating with a common liquid supply chamber; and a movable member having a free end supported at a slight gap with respect to the side of said liquid flow path of said liquid supply port, wherein an area surrounded with at least a free end portion of said movable member and both side portions continued from the free end portion is larger than an opening area to the liquid flow path of said liquid supply port, a period when said movable member seals and shuts off said opening area is provided from when a drive voltage is applied to said bubble generating means until a period of isotropic growth of the entire bubble by said bubble generating means ends, after the period when said movable member seals and shuts off said opening area, and while a portion of the bubble generated by said bubble generating means on the side of said discharge port grows, said movable member starts displacement on the side of said bubble generating means inside said liquid flow path, and liquid supply is enabled to said liquid flow path from said common liquid supply chamber, and when a volume of a liquid droplet discharged from said discharge port is Vd, and during the discharge of the liquid from said discharge port, a drawing volume from the discharge port to a liquid surface retracted to maximum into said liquid flow path is Vm, a relation of Vd>Vm is established.

In the aforementioned constitution, from when the drive voltage is applied to the bubble generating means, until the period of the substantial isotropic growth of the entire bubble by the bubble generating means ends, a communication state between the liquid flow path and the liquid supply port is immediately shut off by the movable member. Therefore, a pressure wave by the bubble growth in the bubble generating area fails to be propagated to the side of the liquid supply port and common liquid supply chamber, a most part of the wave is directed to the discharge port side, and the discharge power is rapidly enhanced. Moreover, even when a recording liquid with a high viscosity is used to fix the liquid to a recording sheet or the like at a high speed or to eliminate blur in a boundary of black and another color, the liquid can satisfactorily be discharged by the rapid enhancement of the discharge power. Moreover, with an environmental change during recording, particularly under an environment with low temperature and low humidity an ink thickening area increases in the discharge port, and the ink fails to be ordinarily discharged at the start of use in some cases, but in the present invention the ink can satisfactorily be discharged from first. Moreover, since the discharge power is rapidly enhanced, for example, by reducing a size of a heat generating member for use as bubble generating means, an energy to be projected for the discharge can be reduced.

Moreover, the movable member is displaced to the side of the bubble generating means with bubble shrinkage, the liquid rapidly flows into the liquid flow path via the liquid supply port from the common liquid supply chamber, and a flow for drawing a meniscus after the discharge into the liquid flow path from the discharge port rapidly decreases. Thereby, a retreat amount of meniscus in the discharge port after liquid droplet discharge decreases. As a result, after the discharge, the meniscus returns to its initial state in a very short time. Specifically, since a time for completing refilling of a constant amount of ink to the liquid flow path is short, even the discharge frequency (drive frequency) can rapidly be enhanced in performing a high-precision (constant-amount) ink discharge.

Other effects of the present invention will be understood from description of respective embodiments.

Additionally, "upstream" and "downstream" for use in the description of the present invention are represented with respect to a flow direction of the liquid toward the discharge port from a liquid supply source via the bubble generating area (or the movable member), or with respect to a constitutional direction.

Moreover, "downstream side" regarding the bubble itself means the bubble generated on a downstream side of the flow direction or the constitutional direction with respect to a bubble center, or in an area on the downstream side from an area center of the heat generating member.

Furthermore, expression "the movable member seals and substantially shuts off the liquid supply port" in the present invention includes a case in which the movable member does not necessarily closely abut on the peripheral portion of the liquid supply port, and limitless approaches the liquid supply port.

BRIEF DESCRIPTION OF THE DRAWINGS

FIGS. 25A-1, 25A-2, 25A-3, 25A-4, 25A-5, 25A-6 and 25A-7 and 25B-1, 25B-2, 25B-3, 25B-4, 25B-5, 25B-6 and 25B-7 are explanatory views of the discharge operation of the liquid discharge heads according to a modification of the first embodiment of the present invention and a comparative mode, showing the liquid discharge head in a view cut along the liquid flow path direction, and showing the characteristic phenomenon in a divided manner.

DETAILED DESCRIPTION OF THE PREFERRED EMBODIMENTS

Embodiments of the present invention will next be described with reference to the drawings.

(First Embodiment)

Figure 1:
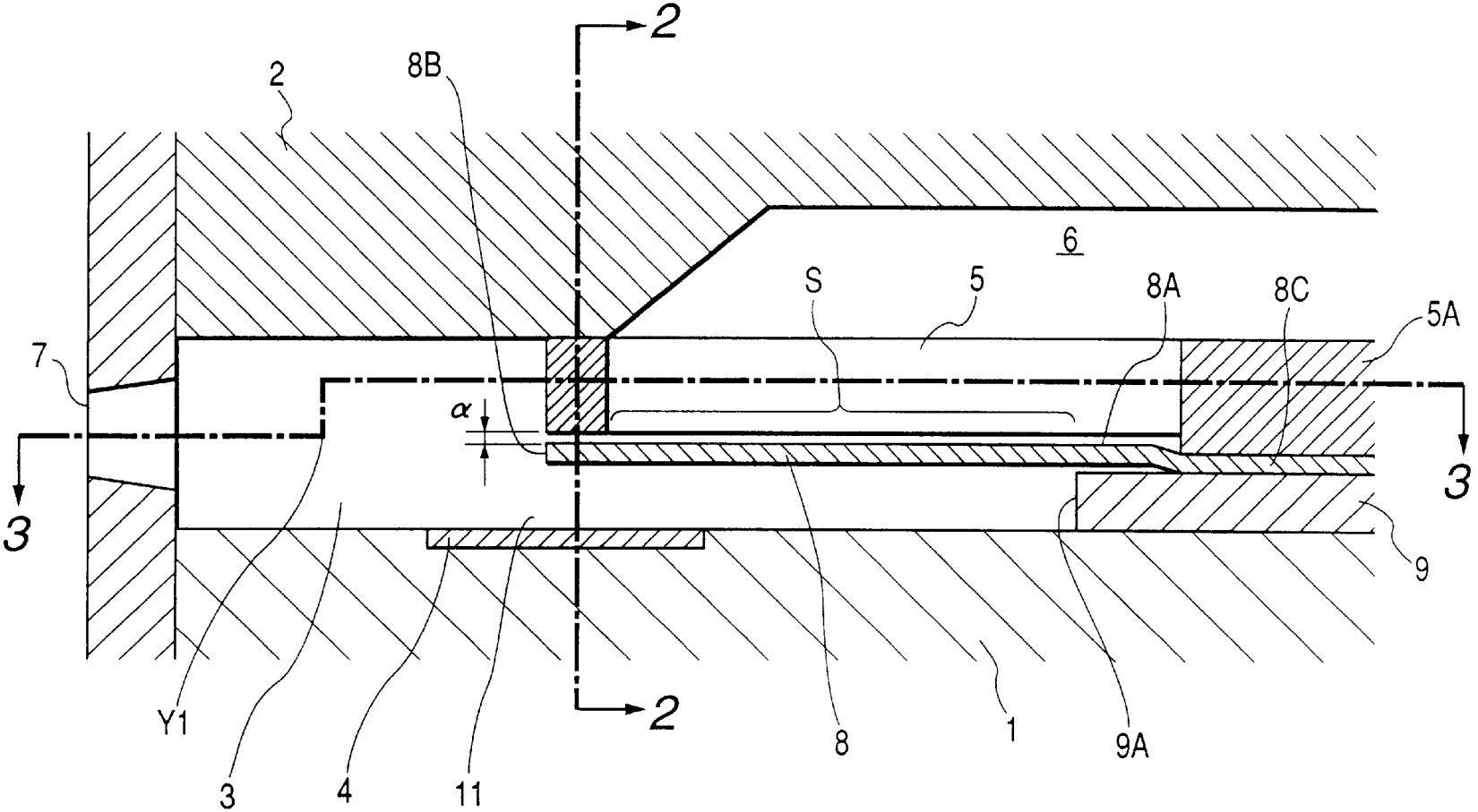
FIG. 1 is a sectional view along one liquid flow path direction of a liquid discharge head according to a first embodiment of the present invention.
Figure 2:
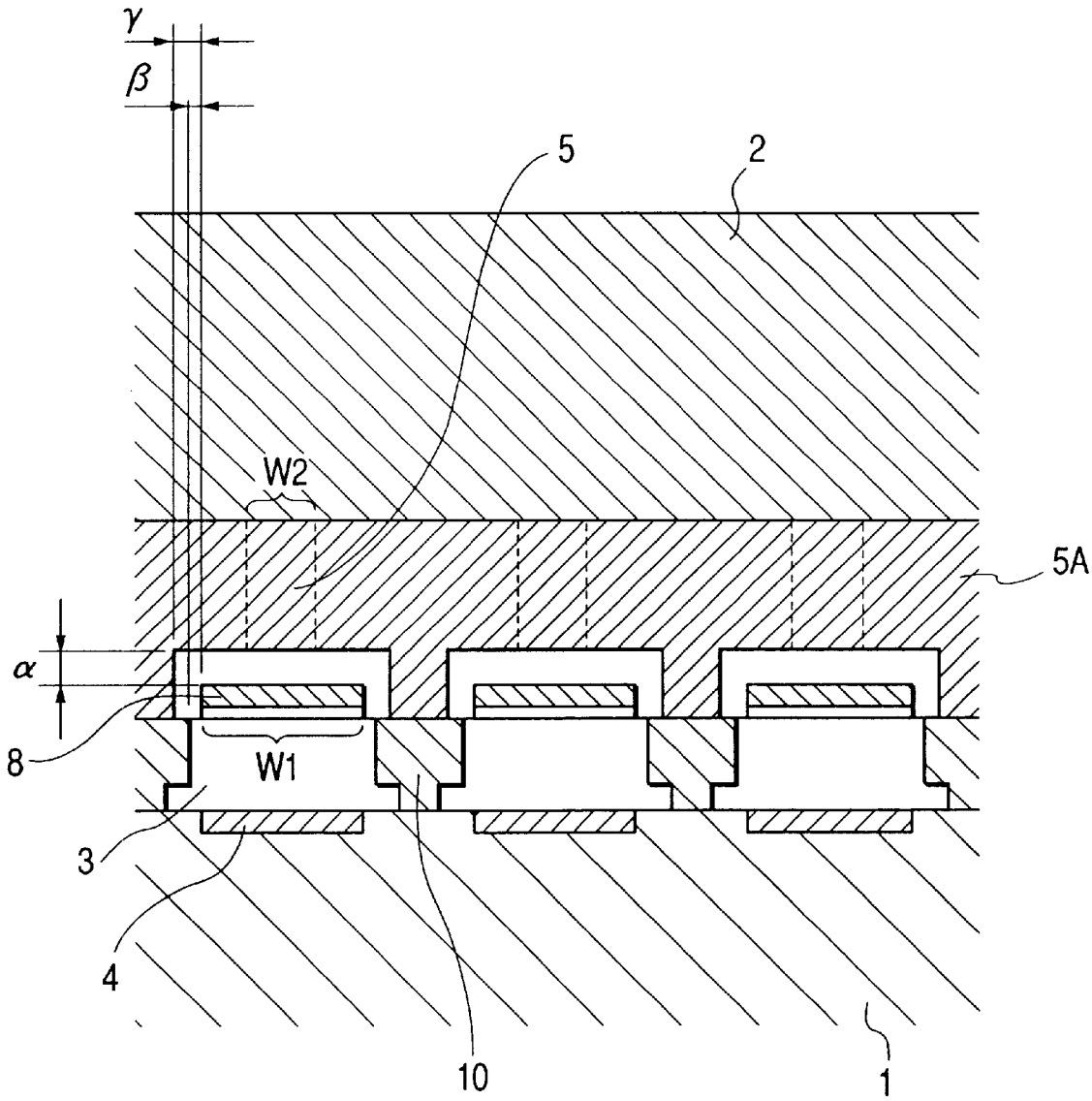
FIG. 2 is a sectional view along a 2—2 line of FIG. 1.
Figure 3:
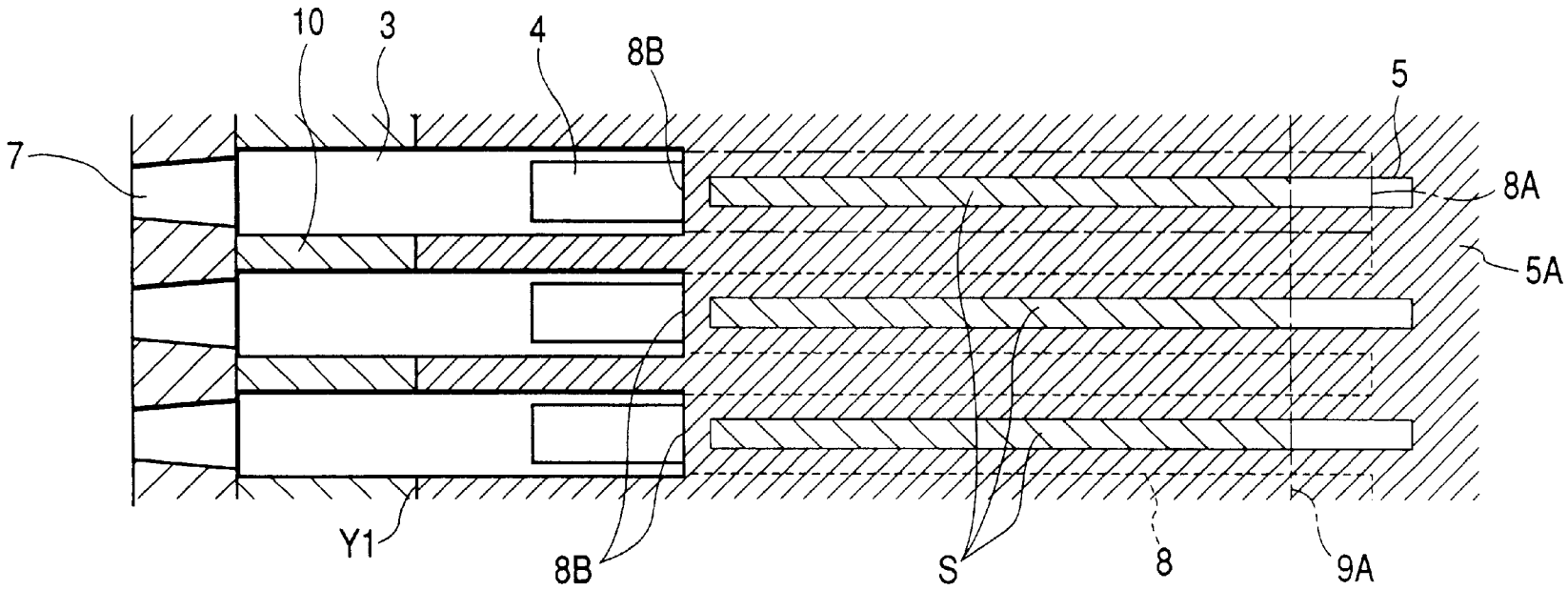
FIG. 3 is a sectional view along a 3—3 line of FIG. 1.

FIG. 1 is a sectional view along one liquid flow path direction of a liquid discharge head according to a first embodiment of the present invention, FIG. 2 is a sectional view along an 2—2 line of FIG. 1, and FIG. 3 is a sectional view along a 3—3 line, shifted to the side of a top plate 2 at a point Y1. from a discharge port center of FIG. 1.

In the liquid discharge head of a plurality of liquid paths-common liquid chamber mode shown in FIGS. 1 to 3, an element substrate 1 is fixed to the top plate 2 via a liquid path side wall 10 in a laminated state, and a liquid flow path 3 whose one end communicates with a discharge port 7 is formed between both plates 1 and 2. A multiplicity of liquid flow paths 3 are disposed on one head. Moreover, with respect to the liquid flow path 3, the element substrate 1 is provided with a heat generating member 4 of an electro-thermal converting element or the like as bubble generating means for generating a bubble in a liquid with which the liquid flow path 3 is replenished. In a vicinity area of a surface on which the heat generating member 4 is in contact with the discharge liquid, a bubble generating area 11 exists in which the heat generating member 4 is rapidly heated and bubbling occurs in the discharge liquid.

Each of the multiplicity of liquid flow paths 3 is provided with a liquid supply port 5 formed by a supply section forming member 5A, and a common liquid supply chamber 6 is disposed to communicate with each liquid supply port 5. Specifically, a configuration is branched to a multiplicity of liquid flow paths 3 from the single common liquid supply chamber 6, and an amount of the liquid adapted to the liquid discharged from the supply port 5 communicating with each liquid flow path 3 is received from the common liquid supply chamber 6. Character S of FIG. 1 denotes a substantial opening area to supply the liquid to the liquid flow path 3 of the liquid supply port.

Between the liquid supply port 5 and the liquid flow path 3, a movable member 8 is disposed with a slight gap a (e.g., 10 $\mu$m or less) and substantially parallel to the opening area S of the liquid supply port 5. An area surrounded with at least a free end portion of the movable member 8 and continued both side portions is larger than the opening area $\beta$ of the liquid supply port 5 (see FIG. 3), and the side portion of the movable member 8 has a slight gap $\beta$ from each of both flow path side walls 10 (see FIGS. 2, 3). The aforementioned supply section forming member 5A has a gap y with respect to the movable member 8 as shown in FIG. 2. The gaps $\beta$, $\gamma$ differ with flow path pitches, but the movable member 8 easily shuts off the opening area S with a large gap $\gamma$, and with a large gap $\beta$ the movable member 8 more easily moves to the side of the element substrate 1 with bubble vanishing than in a stationary state in which the member is positioned via the gap $\alpha$. In the present embodiment, the gap $\alpha$ is set to 1 $\mu$m, gap $\beta$ is 4 $\mu$m, and gap $\gamma$ is 5 $\mu$m. Moreover, the movable member 8 has a width W1 larger than a width W2 of the opening area S in a width direction between the flow path side walls 10, and has a width such that the opening area S is sufficiently sealed. A portion 8B of the movable member 8 defines an upstream side end portion of the opening area S of the liquid supply port 5 on an extended line from the end portion on the side of a free end of a continuous portion by which a plurality of movable members are continued with respect to a direction crossing at right angles to a plurality of liquid paths (the continuous portion is partially apart from a fixing member 9 as shown in FIG. 1) (see FIG. 3). In the present embodiment, as shown in FIGS. 2 and 3, a portion of the supply section forming member 5A along the movable member 8 is set to be thinner than the liquid flow path side wall 10 itself, and the supply section forming member 5A is laminated with respect to the flow path wall 10. Additionally, a thickness of the supply section forming member 5A on the side of the discharge port 7 from a free end 8A of the movable member is set to the same thickness as that of the liquid flow path wall 10 itself as shown in FIG. 3. Therefore, the movable member 8 can move in the liquid flow path 3 without any frictional resistance, and displacement toward the opening area S can be restricted in a peripheral portion of the opening area S. Thereby, the opening area S is substantially closed so that a liquid flow to the common liquid supply chamber 6 from the inside of the liquid flow path 3 can be prevented, while with bubble vanishing, movement is possible from a substantially sealed state to a refill possible state on the side of the liquid flow path. Moreover, in the present embodiment, the movable member 8 is also positioned parallel to the element substrate 1. Furthermore, the end 8B of the movable member 8 is a free end positioned on the side of the heat generating member 4 of the element substrate 1, and the other end is supported by the fixing member 9. Moreover, the fixing member 9 closes an end on the side of the liquid flow path 3 opposite to the discharge port 7.

Figure 4:
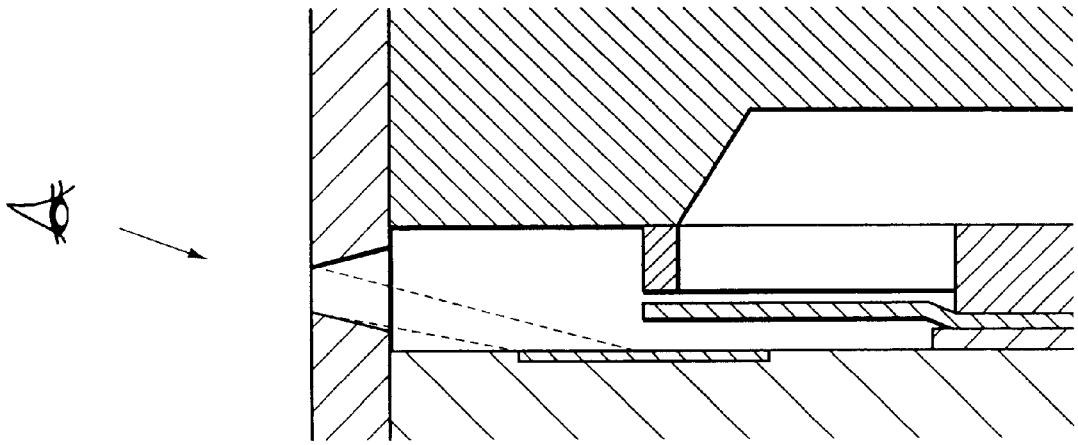
FIG. 4 is a sectional view of the flow path showing "linear communication state".

Additionally, as shown in FIG. 4, in the present embodiment, there is no obstacle like a valve between the heat generating member 4 as the electrothermal converting element and the discharge port 7, and a "linear communication state" is obtained in which a linear flow path structure is kept with respect to the liquid flow. In this case, more preferably, by linearly placing a propagation direction of a pressure wave generated during bubble generation in agreement with a liquid flow direction and discharge direction, an ideal state is preferably formed in which a discharge direction, discharge speed and another discharge state of a discharge droplet are stabilized with a considerably high level. In the present invention, as one definition for achieving or approximating the ideal state, the discharge port 7 may directly linearly be connected to the heat generating member 4, particularly the discharge port side (downstream side) of the heat generating member which exerts an influence on the bubble discharge port side in a constitution. This is a state with no fluid in the flow path, in which the heat generating member, particularly the downstream side of the heat generating member can be observed from the outside of the discharge port (see FIG. 4).

A discharge operation of the liquid discharge head of the present embodiment will next be described in detail. FIGS. 5A to 5D and 6A to 6C are explanatory views of the discharge operation of the liquid discharge head with a structure shown in FIGS. 1 to 3, showing the liquid discharge head in a view cut along a liquid flow path direction, and showing a characteristic phenomenon in divided processes of FIGS. 5A to 5D and 6A to 6C. Moreover, in FIGS. 5A to 5D and 6A to 6C, character M denotes a meniscus formed by the discharged liquid.

Figure 5A:
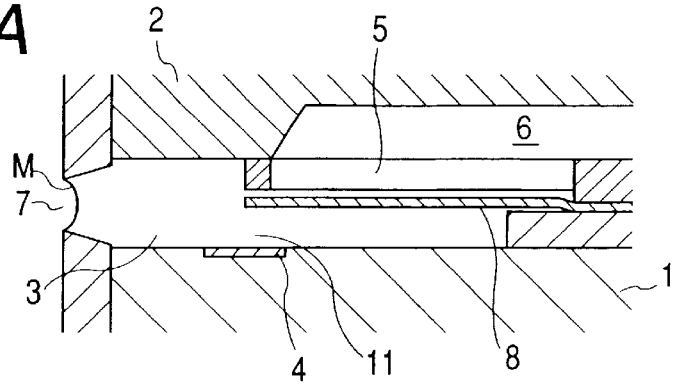
FIGS. 5A, 5B, 5C and 5D are explanatory views of a discharge operation of the liquid discharge head with a structure shown in FIGS. 1 to 3, showing the liquid discharge head in a view cut along a liquid flow path direction, and showing a characteristic phenomenon in a divided manner.

FIG. 5A shows a state before an electric energy or another energy is applied to the heat generating member 4, and a state before the heat generating member generates heat. In this state, a slight gap (10 $\mu$m or less) exists between the movable member 8 disposed between the liquid supply port 5 and the liquid flow path 3, and a forming surface of the liquid supply port 5.

Figure 5B:
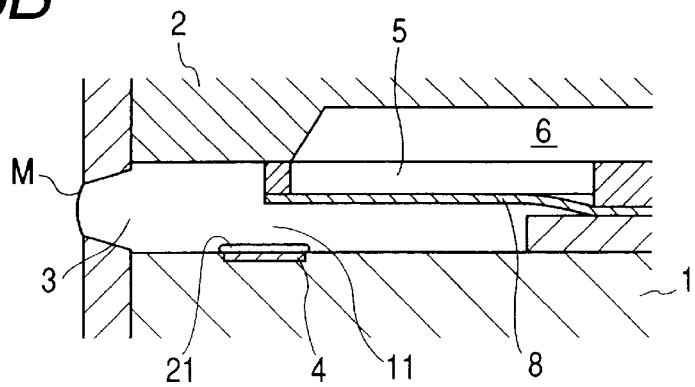

FIG. 5B shows that a part of the liquid in the liquid flow path 3 is heated by the heat generating member 4, film boiling occurs on the heat generating member 4, and a bubble 21 isotropically grows. Here, "the bubble growth is isotropic" means that a bubble growth speed directed in a perpendicular direction of a bubble surface has a substantially equal magnitude in any position of the bubble surface.

In the isotropic growth process of the bubble 21 in an initial stage of bubble generation, the movable member 8 closely abuts on the peripheral portion of the liquid supply port 5 to close the liquid supply port 5, and the inside of the liquid flow path 3 is substantially in a sealed state except the discharge port 7. This sealed state is maintained in any period in the isotropic growth process of the bubble 21. Additionally, the period for maintaining the sealed state may be between when a drive voltage is applied to the heat generating member 4 and when the isotropic growth process of the bubble 21 ends. Moreover, in this sealed state, inertance (difficulty in movement when a still liquid rapidly starts moving) from a center of the heat generating member 4 to the liquid supply port side in the liquid flow path 3 substantially becomes infinite. In this case, the inertance from the heat generating member 4 to the liquid supply port side approaches infinity when more distance is obtained between the heat generating member 4 and the movable member 8.

Figure 5C:
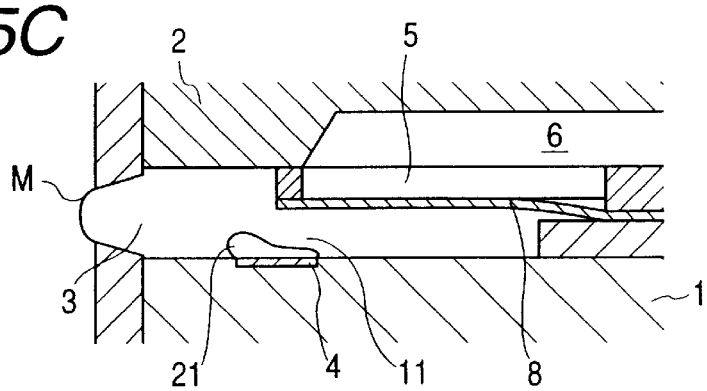
Figure 5D:
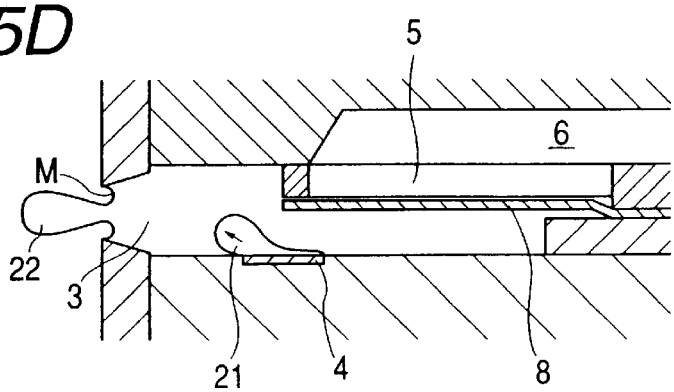

FIG. 5C shows that the bubble 21 continues to grow. As described above, when the liquid flow path 3 is substantially placed in the sealed state excluding the discharge port 7, no liquid flow goes to the liquid supply port 5 side. Therefore, among the bubbles isotropically grown on the heat generating member 4, the bubble on the liquid supply port 5 side cannot grow, and the bubble growth energy is consumed only in the bubble growth on the discharge port 7 side.

Figure 7A:
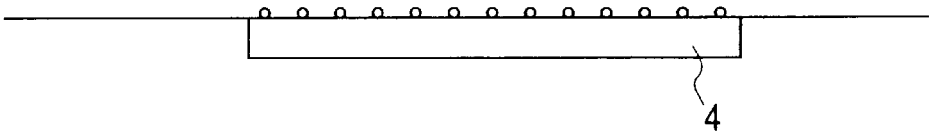
FIGS. 7A, 7B, 7C, 7D and 7E are views of an isotropic growth state of a bubble of FIG. 5B.
Figure 7B:
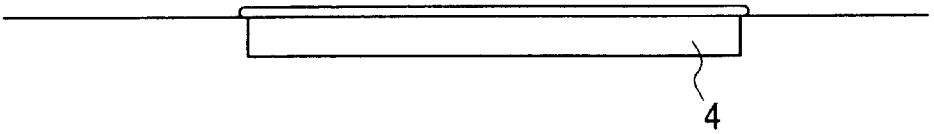
Figure 7C:
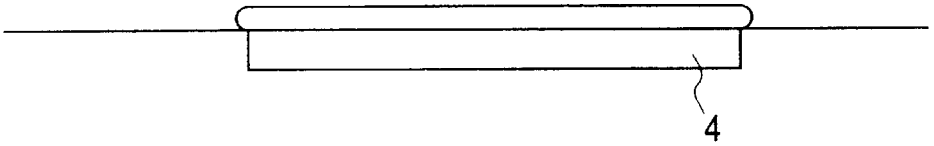

Here, the bubble growth process in FIGS. 5A to 5C will be described in detail with reference to FIGS. 7A to 7E. As shown in FIG. 7A, initial boiling occurs on the heat generating member when the heat generating member is heated, and subsequently as shown in FIG. 7B, the boiling changes to a film boiling in which the heat generating member is covered with the film-like bubble. Moreover, the bubble in a film boiling state continues to isotropically grow as shown in FIGS. 7B and 7C (this isotropic bubble growth state is called a semi-pillow state). Additionally, when the inside of the liquid flow path 3 is substantially in the sealed state excluding the discharge port 7 as shown in FIG. 5B, liquid movement to the upstream side becomes impossible, a part of the bubble on the upstream side (liquid supply port side) in the semi-pillow bubble fails to grow, and only a remaining portion on the downstream side (discharge port side) grows. This state is shown in FIGS. 5C, 7D, 7E.

For the sake of convenience in description, when the heat generating member 4 is heated, an area in which no bubble grows on the heat generating member 4 is referred to as an area B, and an area on the side of the discharge port 7 in which the bubble grows is referred to as an area A. Additionally, a bubbling volume during the isotropic bubble growth is maximized in the area B.

Figure 7D:
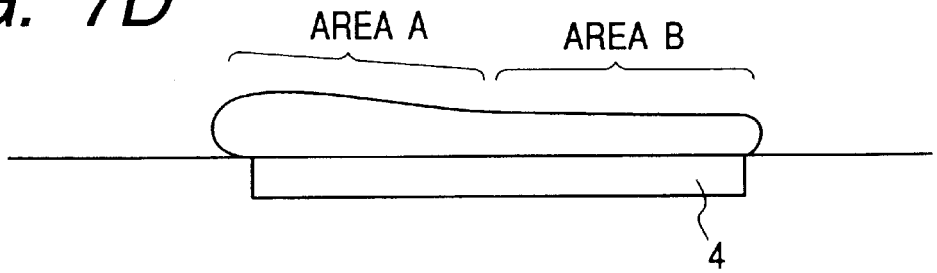
Figure 7E:
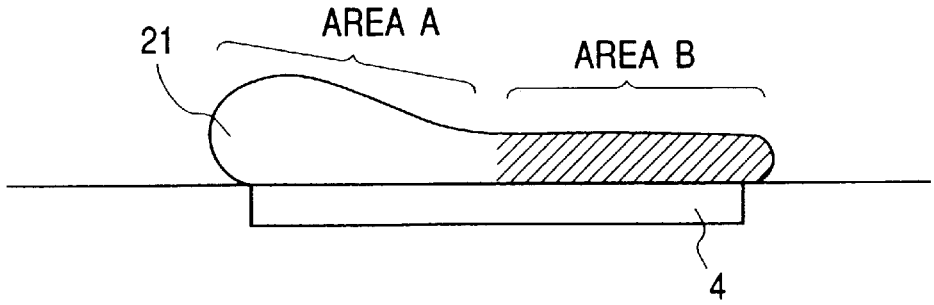

Next FIG. 7D shows that the bubble growth continues in the area A, and bubble shrinkage starts in the area B. In this state, the bubble largely grows toward the discharge port side in the area A. Moreover, the bubble volume in the area B starts to decrease. Thereby, the movable member 8 starts to be displaced downward to a stationary state position in accordance with its restoring force by rigidity and bubble vanishing force in the area B. As a result, the liquid supply port 5 opens, and the common liquid supply chamber 6 is placed in the communication state with the liquid flow path 3.

Figure 6A:
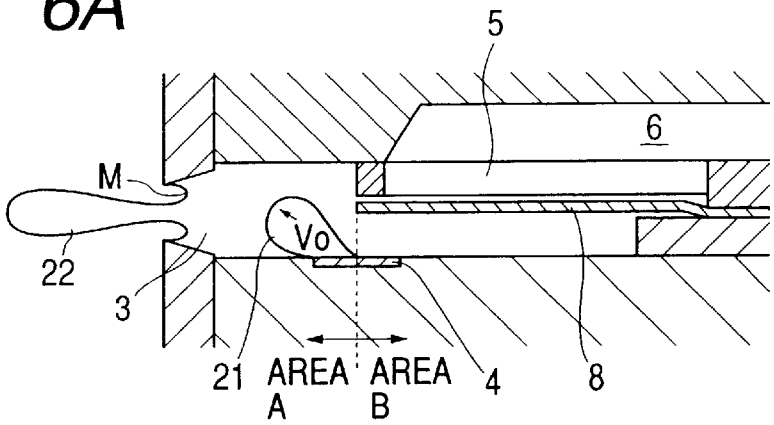
FIGS. 6A, 6B and 6C are views of the liquid discharge head, cut along the liquid flow path direction, to show the discharge operation continued from FIG. 5D.

FIG. 6A shows that the bubble 21 has grown substantially to maximum. In this state, the bubble grows to the maximum in the area A, and accordingly the bubble substantially vanishes in the area B. Moreover, a discharge droplet 22 which is to be discharged from the discharge port 7 trails long and is still connected to the meniscus M. As shown in the drawing, a maximum bubbling volume of the bubble is Vo.

Figure 6B:
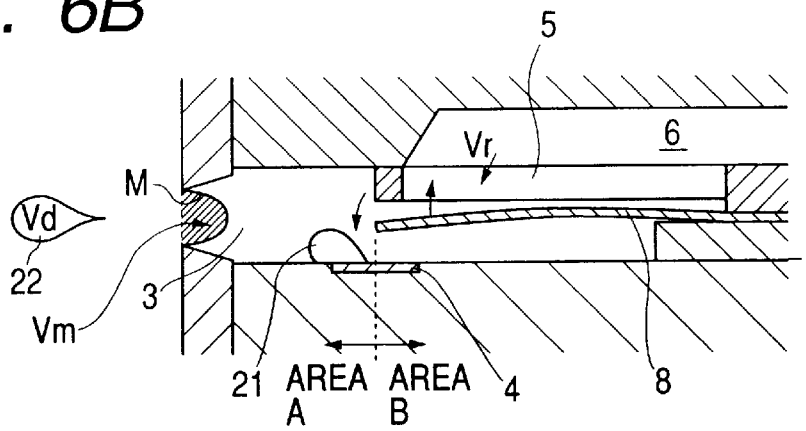

FIG. 6B shows that the bubble 21 stops growing and is in a stage only of a bubble vanishing process, and the discharge droplet 22 is cut from the meniscus M. Immediately after the bubble growth changes to bubble vanishing in the area A, a shrinkage energy of the bubble 21 acts as a force for moving the liquid in the vicinity of the discharge port 7 in an upstream direction as an entire balance. Therefore, the meniscus M is drawn into the liquid flow path 3 from the discharge port 7 at this point of time, and a liquid column connected to the discharge liquid droplet 22 is quickly cut off by a strong force. On the other hand, the movable member 8 is displaced downward with bubble shrinkage, and the liquid rapidly flows as a large flow into the liquid flow path 3 from the common liquid supply chamber 6 via the liquid supply port 5. Thereby, since the flow for rapidly drawing the meniscus M into the liquid flow path 3 is rapidly reduced, the retreat amount of the meniscus M decreases, and the meniscus M starts returning to the position before bubbling with a relatively low speed. As a result, a converging property of vibration of the meniscus M is very satisfactory as compared with the liquid discharge system which is not provided with the movable member of the present invention. Here, as shown in the drawing, a discharge amount is set to Vd, a maximum meniscus retreat amount as a drawing volume from the discharge port to a liquid surface retracted to maximum into the liquid flow path is Vm, and an amount of the liquid moving into the liquid flow path 3 from when the free end of the movable member 8 starts its downward displacement until the retreat amount of the meniscus M is maximized is Vr. Additionally, strictly to say, the retreat amount of the meniscus M is maximized when the vanishing of the bubble 21 ends, but the bubble 21 vanishes by the liquid flowing into the liquid flow path 3 from the common liquid supply chamber 6 via the liquid supply port 5 from the state shown in FIG. 6B until the bubble 21 vanishes, and the retreat amount of the meniscus M in the state shown in FIG. 6B can be said to be substantially a maximum meniscus retreat amount Vm.

Figure 6C:
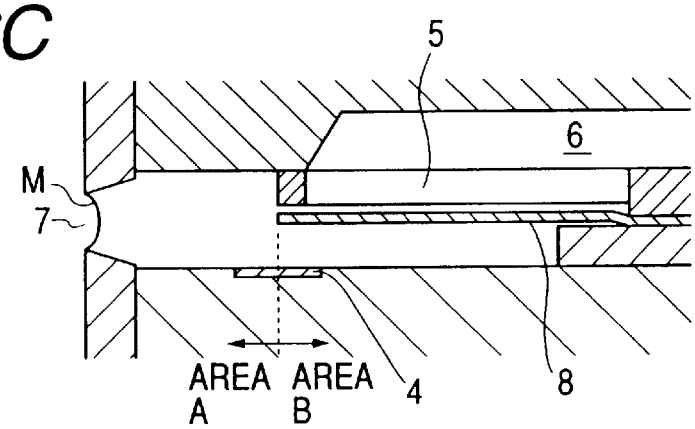

FIG. 6C shows that the bubble 21 completely vanishes, and the movable member 8 also returns to the stationary state position. The movable member 8 is displaced upward to this state by its elastic force (a direction of a solid-line arrow of FIG. 6B). Moreover, in this state, the meniscus M already returns to the vicinity of the discharge port 7.

As seen from the above description and FIGS. 5A to 5D and 6A to 6C, first the movable member 8 inhibits the liquid from flowing toward the liquid supply port 5 in a period when the bubble isotropically grows in the initial stage of bubble generation. Moreover, when the discharged liquid leaves the discharge port 7 to fly, the vanishing of the entire bubble already starts, the movable member 8 is displaced downward at this time, and the liquid flows into the liquid flow path 3 from the common liquid supply chamber 6 via the liquid supply port 5.

Specifically, since the liquid starts flowing inward before being detached from the liquid column, the maximum meniscus retreat volume Vm becomes smaller than a volume attributed to the discharge amount Vd of the flying liquid.

Therefore, the following relation is established.

$$Vd > Vm \tag{1}$$

This means that the meniscus M returns fast, and this can enhance a refill frequency.

Moreover, from the start of the downward displacement of the free end of the movable member 8 until the retreat amount of the meniscus M reaches the maximum, a difference between the discharge amount Vd of the flying liquid and the maximum meniscus retreat volume Vm fails to become larger than the amount Vr of the liquid flowing into the liquid flow path 3.

Therefore, the following relation is established.

$$Vd - Vm \leqq Vr \tag{2}$$

It will next be described with reference to FIGS. 25A-1 to 25A-7 and 25B-1 to 25B-7 that the establishment of the relation of Vd>Vm as described above accelerates the returning of the meniscus M.

Figures 1, 25A:
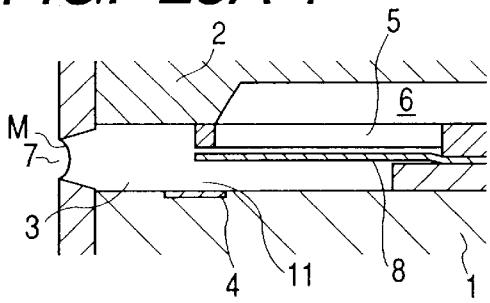
Figures 5, 25A:
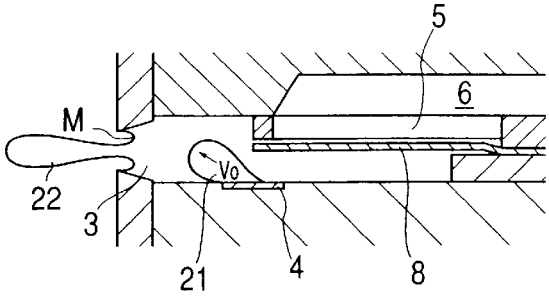
Figures 2, 25A:
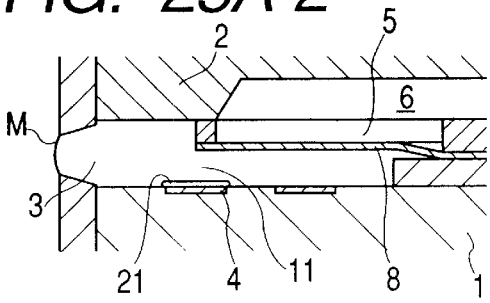
Figures 6, 25A:
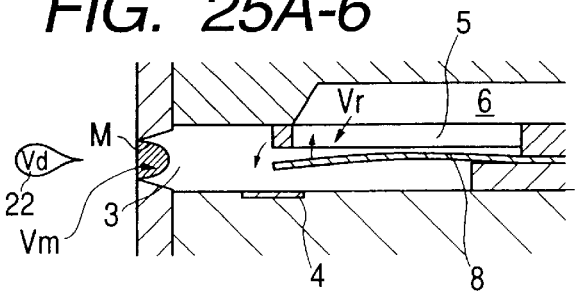
Figures 3, 25A:
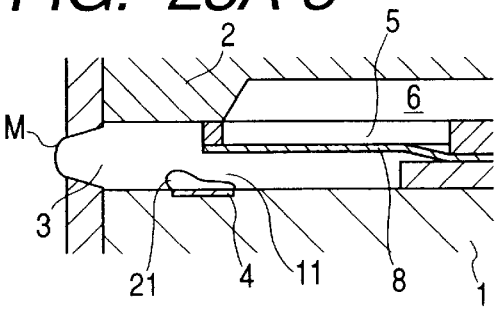
Figures 7, 25A:
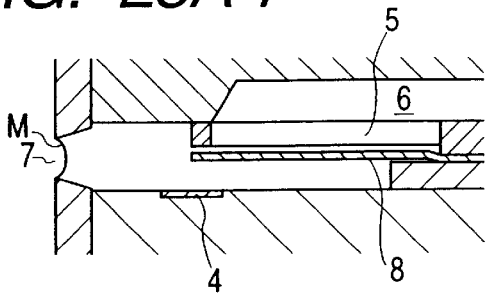
Figures 4, 25A:
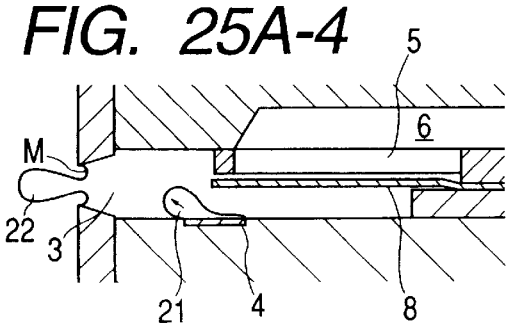
Figures 1, 25B:
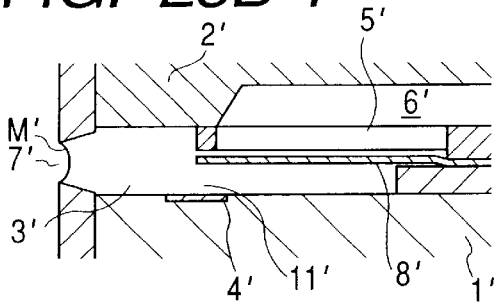
Figures 5, 25B:
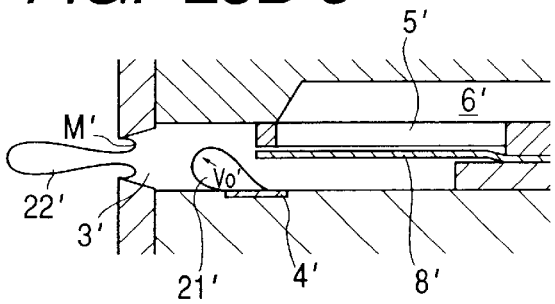
Figures 2, 25B:
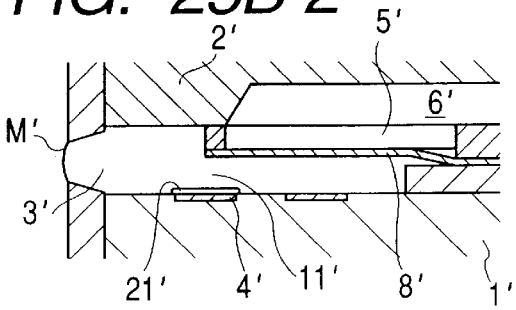
Figures 6, 25B:
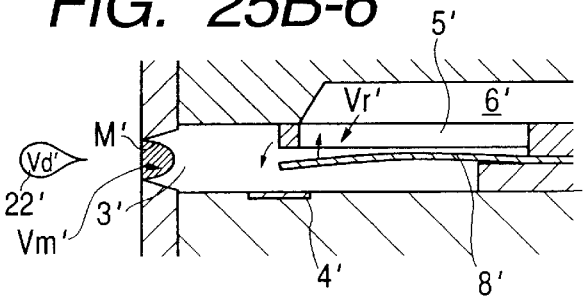
Figures 3, 25B:
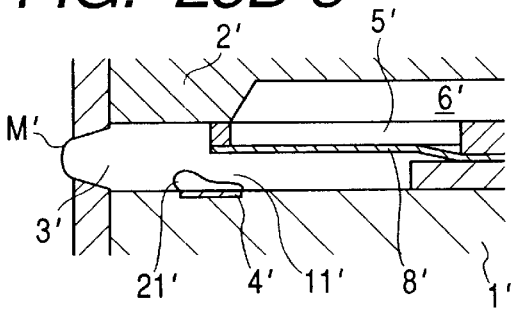
Figures 7, 25B:
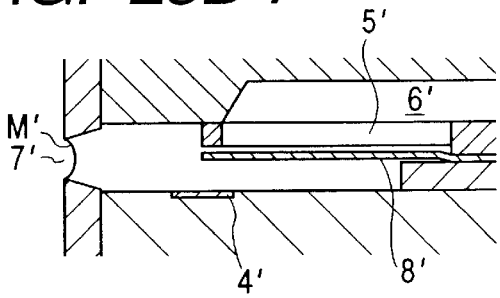
Figures 4, 25B:
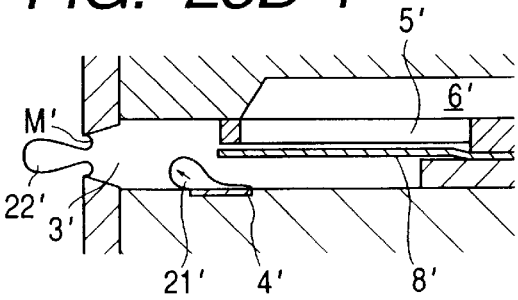

FIGS. 25A-1 to 25A-7 are views of the liquid discharge head cut along the liquid flow path direction according to a modification of the present embodiment in which the relation of Vd>Vm is established, and FIGS. 25B-1 to 25B-7 are views of the liquid discharge head cut along the liquid flow path direction according to a comparative mode in which a relation of Vd'>Vm' is established. The liquid discharge head according to the present modification is different from the liquid discharge head according to the comparative mode in positions of heat generating members 4, 4'. Moreover, the liquid discharge head according to the present modification is driven on the same drive conditions as those of the liquid discharge head according to the comparative mode. Moreover, the states of the liquid discharge heads shown in FIGS. 25A-1 to 25A-7 and 25B-1 to 25B-7 substantially correspond to the states of the liquid discharge heads shown in FIGS. 5A to 5D and 6A to 6C.

Here, when the state of the liquid discharge head shown in FIG. 25A-6 is compared with that shown in FIG. 25B-6, the maximum meniscus retreat amount Vm is substantially equal to the amount Vm', but the discharge amount Vd in the liquid discharge head according to the present modification shown in FIG. 25A-6 is larger than the discharge amount Vd' in the liquid discharge head according to the comparative mode shown in FIG. 25B-6. This means that since both drive conditions are the same, the liquid discharge head according to the present modification is higher than the liquid discharge head according to the comparative mode in discharge efficiency. Therefore, it can further be said that by selecting the drive condition such that both discharge amounts are the same, the liquid discharge head according to the present modification becomes smaller than the liquid discharge head of the comparative mode in the maximum retreat amount of the meniscus. Therefore, in the liquid discharge head according to the present modification in which the relation of Vd>Vm is established, the meniscus M returns more quickly than in the liquid discharge head according to the comparative mode in which the relation of Vd'>Vm' is established. Therefore, the establishment of the relation of Vd>Vm means the quick returning of the meniscus M.

Figure 8:
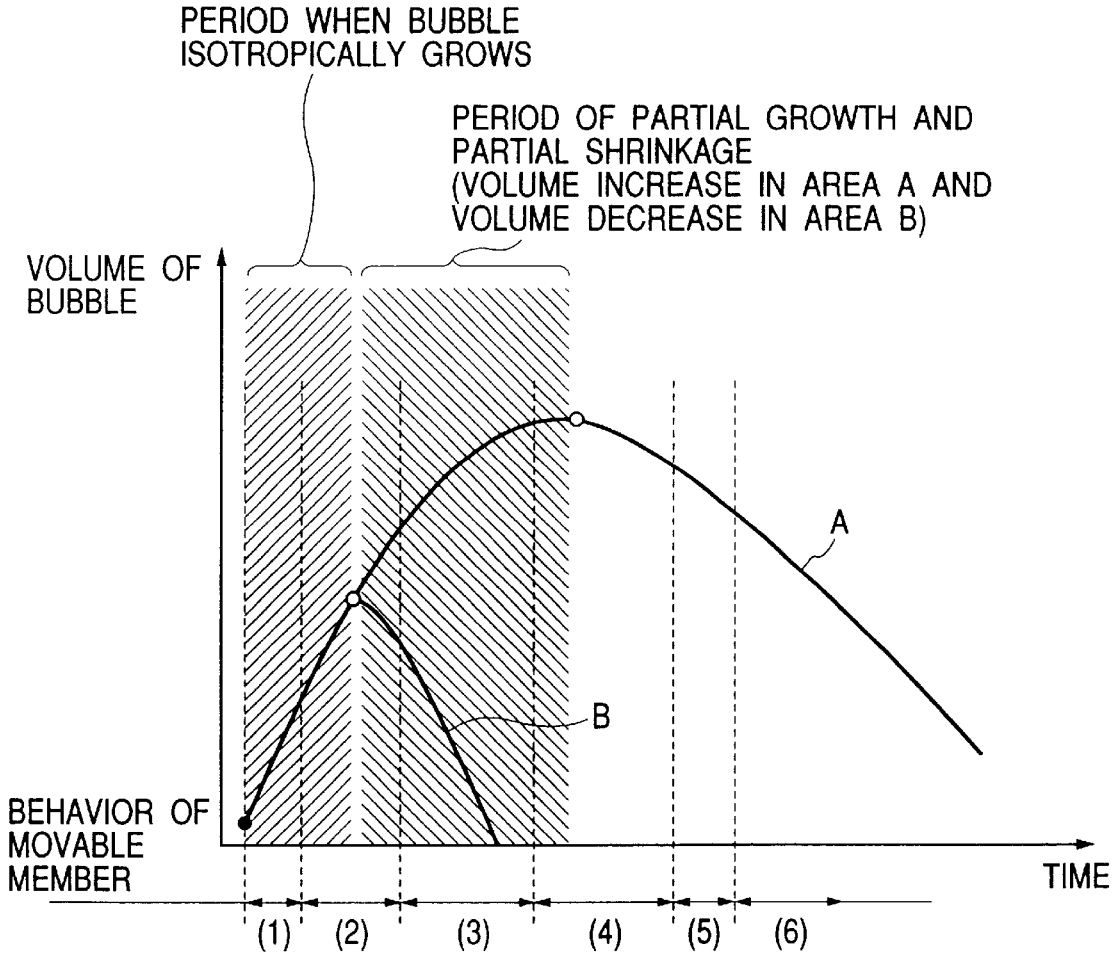
FIG. 8 is a graph showing a correlation between a change of bubble growth with time in areas A and B shown in FIG. 4 and a behavior of a movable member.

A correlation between a change of bubble volume with time in areas A and B shown in FIGS. 5A to 5D and 6A to 6C and a behavior of the movable member will next be described with reference to FIG. 8. FIG. 8 is a graph showing the correlation, curve A shows the change of bubble volume with time in the area A, and curve B shows the change of bubble volume with time in the area B.

As shown in FIG. 8, the change of bubble growth 30 volume with time in the area A draws a parabola having a maximum value. Specifically, the bubble volume increases with an elapse of time from the start of bubbling until the bubble vanishing, reaches the maximum at a certain point of time, and subsequently decreases. On the other hand, with respect to the area B, as compared with the area A, time required from the start of bubbling until the bubble vanishing is short, the maximum growth volume of the bubble is small, and time until the growth volume reaches the maximum is also short. Specifically, the area A is largely different from the area B in the time required from the bubbling start until the bubble vanishing and the bubble growth volume change, and those of the area B are smaller.

Particularly in FIG. 8, since the bubble volume increases with the same time change in the initial stage of the bubble generation, the curve A is superposed on the curve B. Specifically, a period when the bubble isotropically grows (in the semi-pillow state) is generated in the initial stage of the bubble generation. Thereafter, the curve A draws a curve to increase to a maximum point, but the curve B is branched from the curve A at the certain point of time to draw a curve along which the bubble volume decreases. Specifically, a period when the bubble volume increases in the area A, but decreases in the area B (a period of partial growth and partial shrinkage) is generated.

Furthermore, in a mode in which a part of the heat generating member is covered with the free end of the movable member based on the aforementioned way of bubble growth as shown in FIG. 1, the movable member provides the following behavior. Specifically, the movable member is displaced upward toward the liquid supply port in a period (1) of FIG. 8. In a period (2) of FIG. 8 the movable member closely abuts on the liquid supply port, and the inside of the liquid flow path is substantially in the sealed state excluding the discharge port. The sealed state is started in the period when the bubble isotropically grows. Next in a period (3) of FIG. 8, the movable member is displaced downward toward the stationary. state position. The opening of the liquid supply port by the movable member is started after a fixed time elapses after the start of the period of partial growth and partial shrinkage. Subsequently in a period (4) of FIG. 8, the movable member is further displaced downward from the stationary state. Next in a period (5) of FIG. 8, the downward displacement of the movable member substantially stops, and the movable member is in an equilibrium state in its opened position. Finally in a period (6) of FIG. 8, the movable member is displaced upward toward the stationary state position.

The correlation between the bubble growth and the movable member behavior is influenced by the relative positions of the movable member and heat generating member. Here, the correlation between the bubble growth and the movable member behavior in the liquid discharge head provided with the movable member and heat generating member in relative positions different from the positions in the present mode will next be described with reference to FIGS. 9A, 9B, 10A and 10B.

Figure 9A:
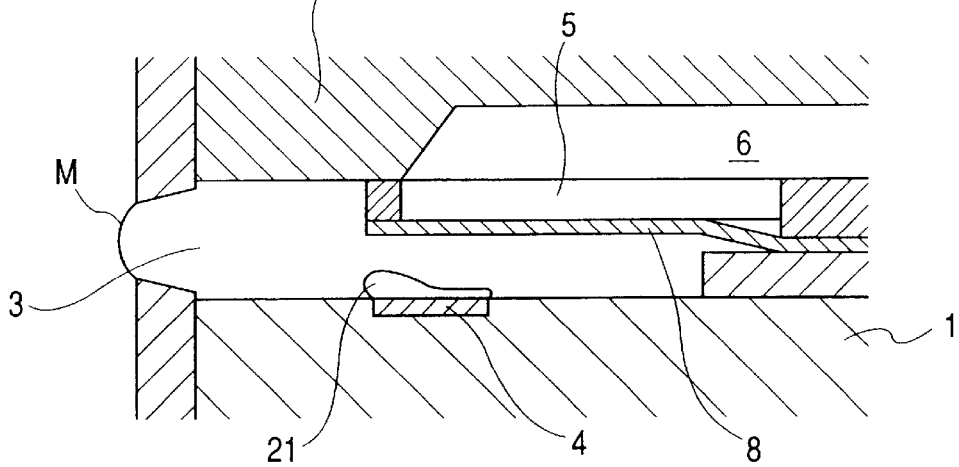
FIG. 9A is a view of the liquid discharge head with a relative position between the movable member and a heat generating member different from the relative position shown in FIG. 1.
Figure 9B:
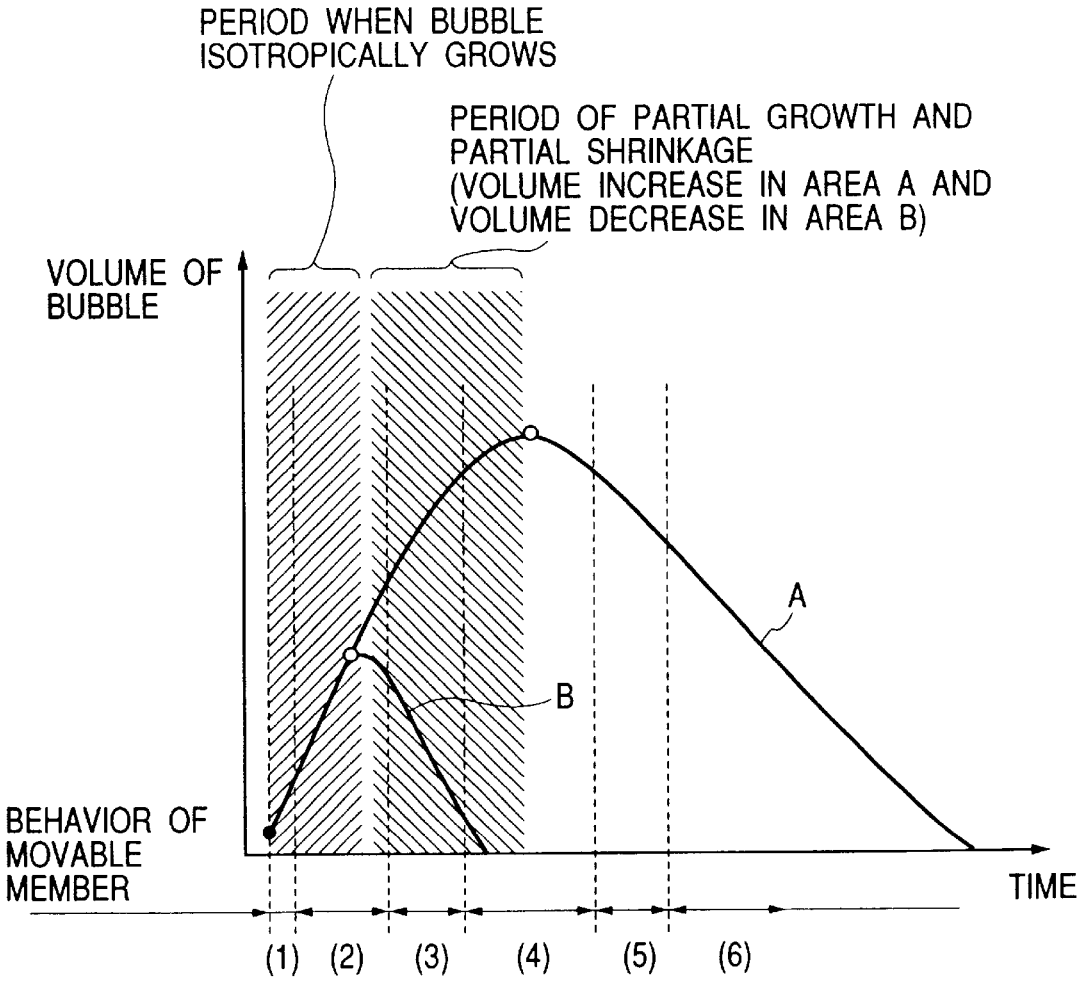
FIG. 9B is a graph showing the correlation between the change of bubble growth with time and the behavior of the movable member.

FIGS. 9A and 9B are explanatory views of the correlation between the bubble growth and the movable member behavior in a mode in which the entire heat generating member is covered with the free end of the movable member, FIG. 9A shows the mode, and FIG. 9B is a graph of the correlation. When an area of the heat generating member overlapped with the movable member is large as shown by the mode of FIG. 9A, period (1) of FIG. 9B is short time as compared with the mode of FIG. 1, and more preferably the heat generating member is placed in the sealed state in a short time after being heated. Additionally, the behaviors of the movable member in respective periods (1) to (6) of FIG. 9B are the same as the behaviors described with reference to FIG. 8. Moreover, in the mode of FIG. 9A, since the movable member is easily influenced by the bubble volume decrease, as seen from a start point of period (3) of FIG. 9B, the opening of the liquid supply port by the movable member is started immediately after the start of the period of partial growth and partial shrinkage. Specifically, the opening timing of the movable member is fast as compared with the mode of FIG. 1. For similar reasons, an amplitude of movable member 8 is enlarged.

Figure 10A:
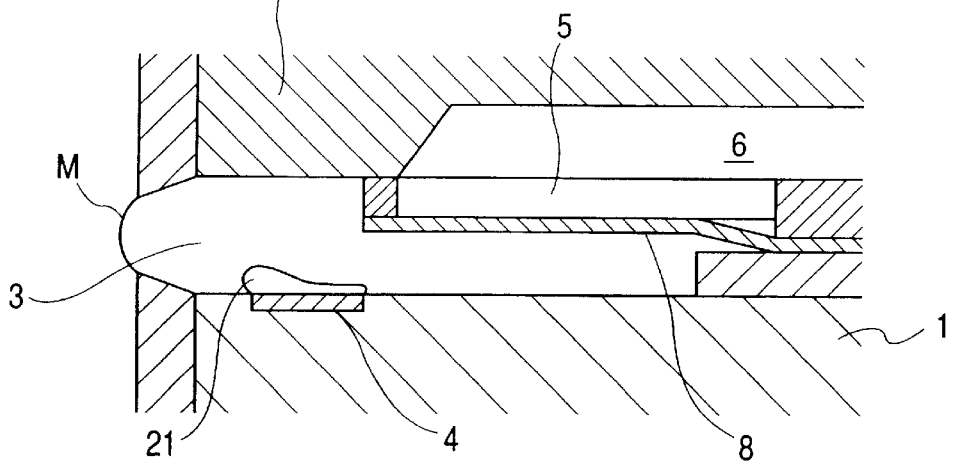
FIG. 10A is a view of the liquid discharge head with the relative position between the movable member and the heat generating member different from the relative position shown in FIG. 1.
Figure 10B:
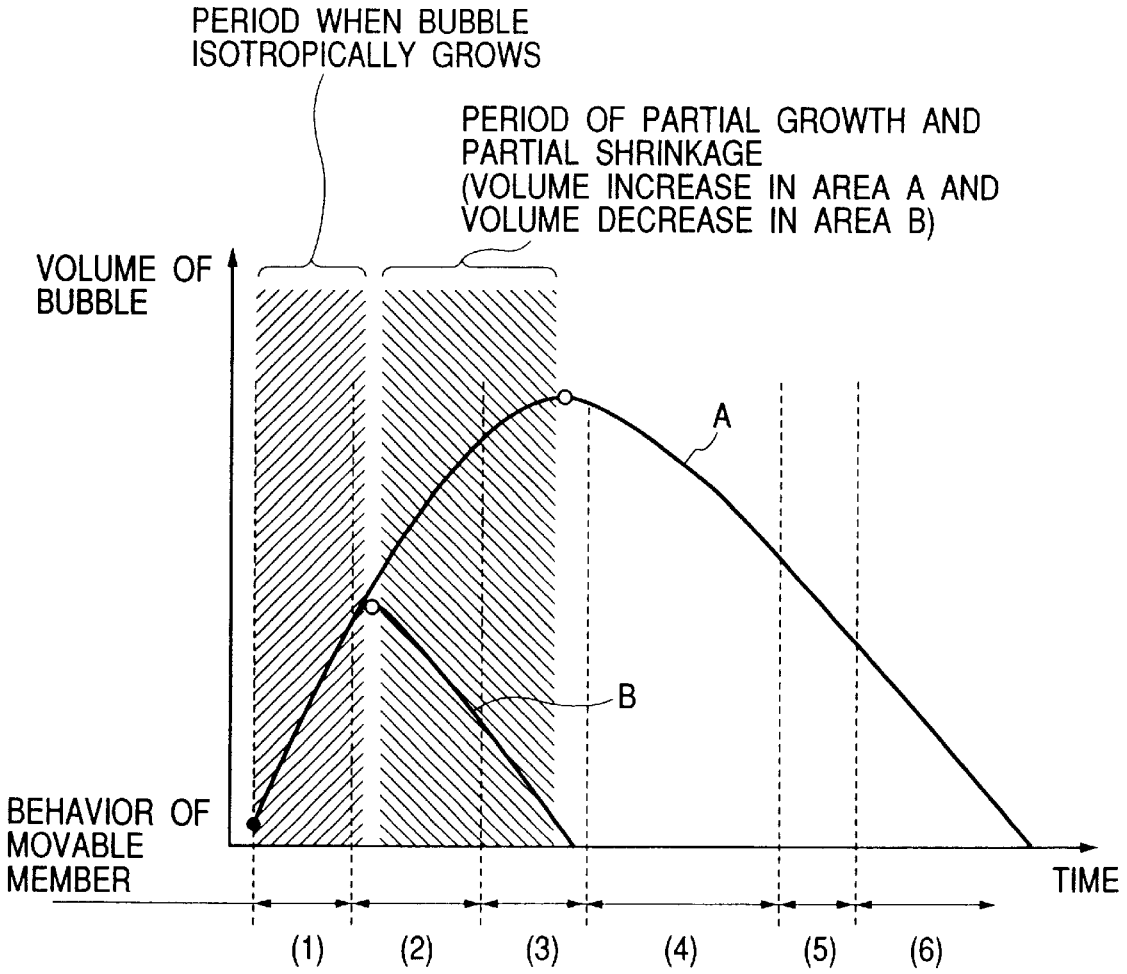
FIG. 10B is a graph showing the correlation between the change of bubble growth with time and the movable member behavior.

FIGS. 10A and 10B are explanatory views of the correlation between the bubble growth and the movable member behavior in a mode in which the heat generating member is apart from the movable member, FIG. 10A shows the mode, and FIG. 10B is a graph of the correlation. When the heat generating member is apart from the movable member as shown by the mode of FIG. 10A, the movable member is not easily influenced by the bubble volume decrease, and as seen from the start point of period (3) of FIG. 10B, the opening of the liquid supply port by the movable member is started considerably later from the start of the period of partial growth and partial shrinkage. Specifically, the opening timing of the movable member is slow as compared with the mode of FIG. 1. For similar reasons, the amplitude of the movable member is reduced. Additionally, the behaviors of the movable member in respective periods (1) to (6) of FIG. 10B are the same as the behaviors described with reference to FIG. 8.

Additionally, for the position relation between the movable member 8 and the heat generating member 4 the general operation has been described, and respective operations differ with the position of the movable member free end, the rigidity of the movable member, and the like.

The head constitution and liquid discharge operation of the present embodiment have been described above, and according to the mode, growth components to downstream and upstream sides of the bubble are not uniform, most of the growth components toward the upstream side are eliminated and the movement of the liquid to the upstream side is inhibited. Since the liquid flow to the upstream side is inhibited, most of the bubble growth components on the upstream side are directed toward the discharge port without any loss, and discharge force is considerably enhanced. Furthermore, the retreat amount of meniscus after the discharge decreases, and accordingly an amount of the meniscus protruded from an orifice surface during refill also decreases. Therefore, meniscus vibration is inhibited and stable discharge can be performed in any drive frequency from a low frequency to a high frequency.

An example of manufacture process will next be described with reference to FIGS. 11 to 11D, 12A to 12C and 13A to 13C, in which the movable member 8, flow path side wall 10 and liquid supply port 5 are disposed on the element substrate 1 as shown in FIGS. 1 to 3. Additionally, FIGS. 11A to 11D, 12A to 12C and 13A to 13C show the process by a surface cut along a direction crossing at right angles to the direction of the liquid flow path formed on the element substrate.

Figure 11A:
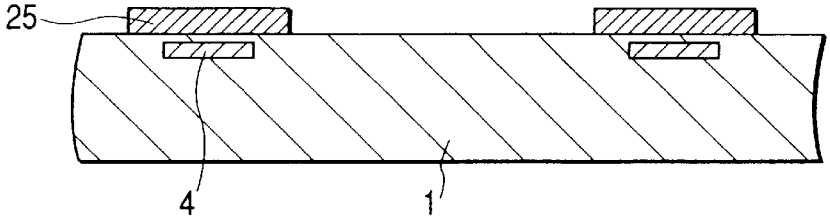
FIGS. 11A, 11B, 11C and 11D are explanatory views of a method of manufacturing the liquid discharge head according to the first embodiment of the present invention.

First, in FIG. 11A, an Al film is formed on a surface on the side of the heat generating member 4 of the element substrate 1 in a thickness of about 2 $\mu$m by a sputtering method. The formed Al film is patterned using a known photolithography process, and a plurality of Al film patterns 25 are formed in positions corresponding to the heat generating members 4. Each of the Al film patterns 25 is extended to an area in which an SiN film 26 as a material film for partially forming the support member 9 and flow path side wall 10 is etched in a process of FIG. 11C described later.

The Al film pattern 25 functions as an etching stop layer during formation of the liquid flow path 3 by dry etching as described later. This is because a TiW layer as a pad protective layer in the element substrate 1, Ta film as a cavitation-resistant film, and SiN film as a protective layer on a resistor are etched by etching gas for use in forming the liquid flow path 3, and the etching of these layers or films is prevented by the Al film pattern 25. Therefore, a width along a direction crossing at right angles to the flow path direction of the liquid flow path 3 in the Al film pattern 25 is set to be larger than the width of the finally formed liquid flow path 3 so that the surface of the element substrate 1 on the side of the heat generating member 4, or the TiW layer on the element substrate 1 is prevented from being exposed during the formation of the liquid flow path 3 by dry etching.

Furthermore, during the dry etching, ionic species and radicals are generated by decomposition of $CF_4$, $C_xF_y$, $SF_6$ gas, and the heat generating member 4 and function element of the element substrate 1 are damaged in some cases, but the Al film pattern 25 receives these ionic species and radicals to protect the heat generating member 4 and function element of the element substrate 1.

Figure 11B:
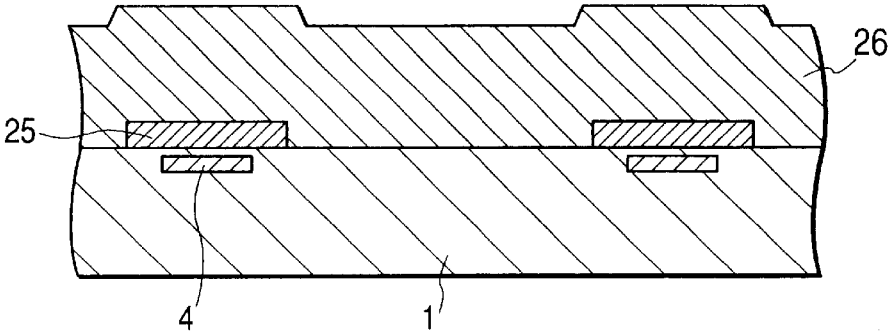

Subsequently, in FIG. 11B, the SiN film 26 with a thickness of about 20.0 $\mu$m as the material film for forming a part of the flow path side wall 10 is formed using a plasma CVD method on the surface of the Al film pattern 25 and the surface of the element substrate 1 on the side of the Al film pattern 25 to cover the Al film pattern 25.

Figure 11C:
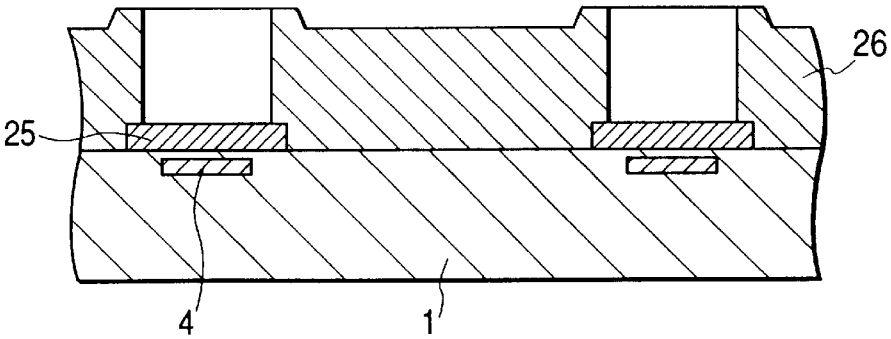

Subsequently, in FIG. 11C, after forming the Al film on the entire surface of the SiN film 26, by using photolithography or another known method to pattern the formed Al film, the Al film (not shown) is formed on a portion of the surface of the SiN film 26 excluding the portion for forming the liquid flow path 3. Subsequently, by using an etching apparatus using a dielectric bonding plasma to etch the SiN film 26, a part of the flow path side wall 10 is formed. In the etching apparatus, by using mixture gas of $CF_4$,$O_2$, $SF_6$, or the like, and using the Al film pattern 25 as the etching stop layer, the SiN film 26 is etched. Constituting materials of a close abutment portion of the support member 9 of movable member 8 and the element substrate 1 include TiW as the constituting material of a pad protective layer, and Ta as the constituting material of the cavitation-resistant film of the element substrate 1.

Subsequently, in FIG. 11D, an Al film 27 with a thickness of 20.0 $\mu$m is formed on the surface of the SiN film 26 by the sputtering method, and a hole formed by etching the SiN film 26 as the portion for forming the liquid flow path 3 in a preprocess is filled with Al.

Figure 11D:
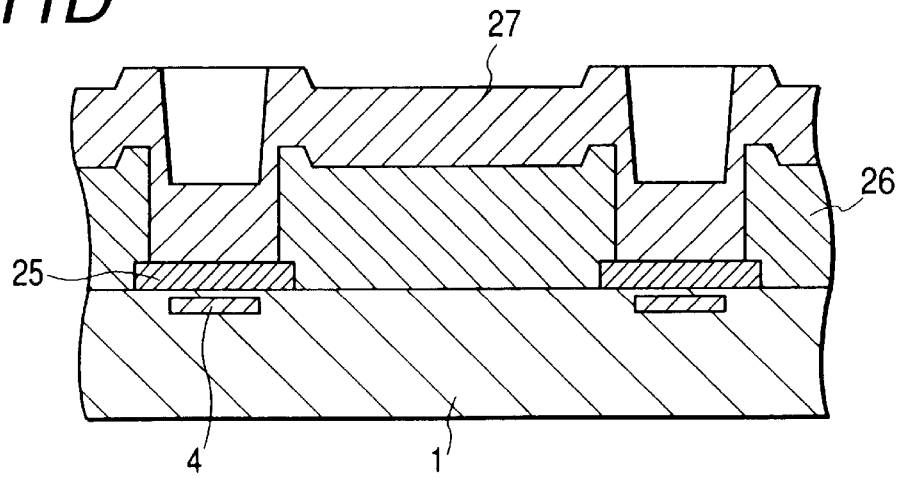
Figure 12A:
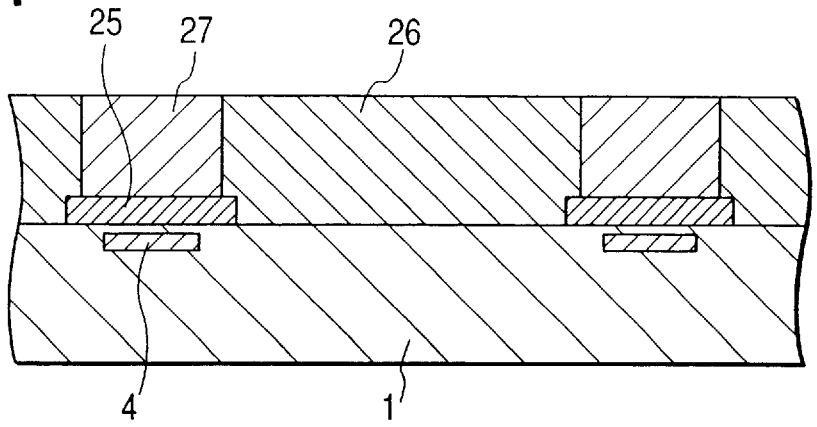
FIGS. 12A, 12B and 12C are explanatory views of the method of manufacturing the liquid discharge head according to the first embodiment of the present invention.

Moreover, in FIG. 12A, the surfaces of the SiN film 26 and Al film 27 on the substrate 1 shown in FIG. 11D are flatly polished by chemical mechanical polishing (CMP).

Figure 12B:
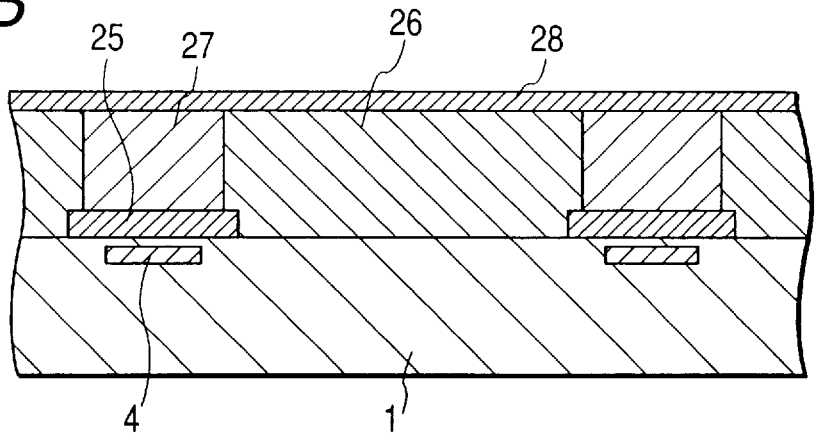

Subsequently, in FIG. 12B, after forming an Al film 28 in a thickness of about 2.0 $\mu$m on the surfaces of the SiN film 26 and Al film 27 polished by the CMP by the sputtering method, the formed Al film 28 is patterned using the known photolithography process. The pattern of the Al film 28 is extended to an area in which an SiN film 29 as the material film for forming a base portion (or fixing portion) to form a bond portion of the movable member 8 and support member is etched in a process of FIG. 12C described later. The Al film 28 functions as the etching stop layer during formation of the movable member 8 by dry etching as described later. Specifically, the SiN film 26 as a part of the liquid flow path 3 is prevented from being etched by the etching gas for use in forming the movable member 8.

Figure 12C:
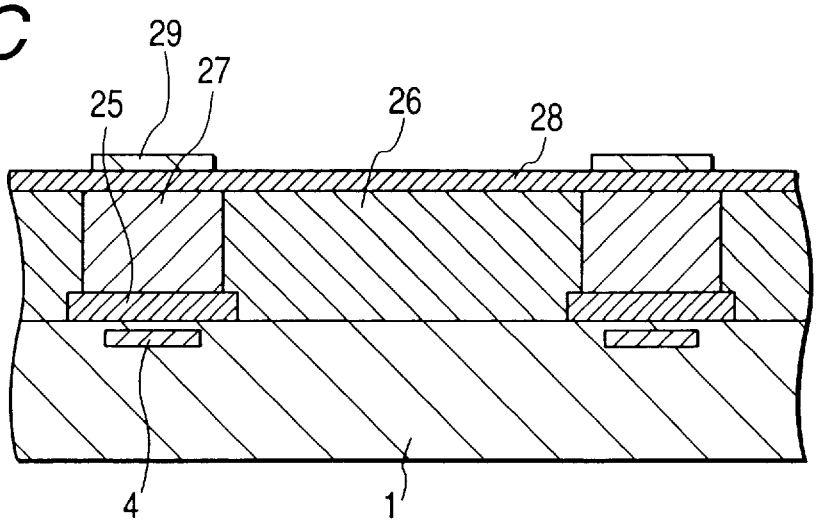

Next in FIG. 12C, an SiN film with a thickness of about 3.0 $\mu$m as the material film for forming the movable member 8 is formed on the surface of the Al film 28 using the plasma CVD method. Subsequently, the formed SiN film is dry-etched using the etching apparatus using the dielectric bonding plasma to leave the SiN film 29 in a place corresponding to the Al film 28 as a part of the liquid flow path 3. The method by the etching apparatus is similar to that of the process of FIG. 11C. Since the SiN film 29 finally forms the movable member 8, the width along the direction crossing at right angles to the flow path direction of the liquid flow path 3 in the pattern of the SiN film 29 is smaller than the width of the finally formed liquid flow path 3.

Figure 13A:
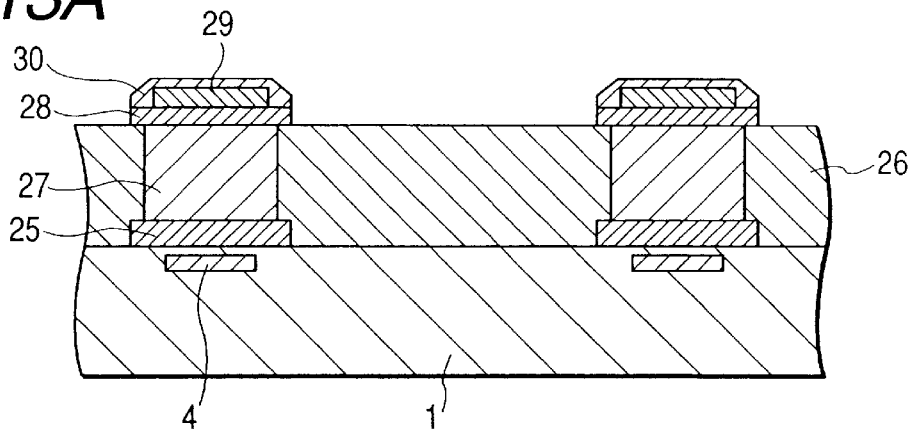
FIGS. 13A, 13B and 13C are explanatory views of the method of manufacturing the liquid discharge head according to the first embodiment of the present invention.

Subsequently, in FIG. 13A, an Al film with a thickness of 3.0 $\mu$m as the material film for forming a gap forming member 30 is formed on the surface of the Al film 28 by the sputtering method to cover the SiN film 29. By using the known photolithography process to pattern the Al film formed into the Al film 28 in the preprocess, the gap forming member 30 for forming the gap a between the top surface of movable member 8 and the liquid supply port 5 and the gap β between the side portion of movable member 8 and the flow path side wall 10 shown in FIG. 2 is formed on the surface and side surface of the SiN film 29.

Figure 13B:
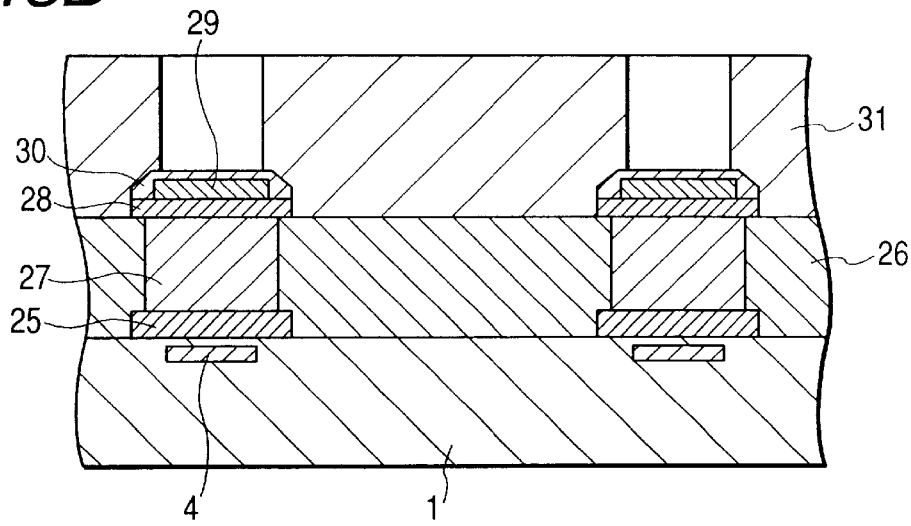

Next, in FIG. 13B, on the SiN film 26, a negative photosensitive epoxy resin 31 consisting of a material shown in the following Table 1 is applied with a thickness of 30.0 μm on the substrate including the gap forming member 30 of the Al film by spin coating. Additionally, in the aforementioned spin coating process, the epoxy resin 31 as a part of the flow path side wall 10 to which the top plate 2 is bonded can flatly be applied.

TABLE 1

| | |
|---|---|
| Material | SU-8-50 (manufactured by Microchemical Corp.) |
| Coat thickness | 50 μm |
| Pre-baking | 90° C., 5 minutes, hot plate |
| Exposure apparatus | MPA600 (mirror projection aligner manufactured by Cannon Inc.) |
| Exposure light amount | 2 [J/cm$^2$] |
| PEB | 90° C., 5 minutes, hot plate |
| Developing liquid | propylene glycol 1-monomethyl ether acetate (Kishida Kagaku) |
| Baking proper | 200° C., 1 hour |

Subsequently, as shown in the above Table 1, after a hot plate is used to perform pre-baking of the epoxy resin 31 on conditions of 90° C. and five minutes, an exposure apparatus (manufactured by Cannon Inc.: MPA600) is used to subject the epoxy resin 31 to exposure in a predetermined pattern with an exposure light amount of 2 [J/cm$^2$]. For the negative-type epoxy resin, an exposed portion is cured, and a non-exposed portion is not cured. Therefore, only a place excluding a portion to form the liquid supply port 5 is exposed in the aforementioned exposure process. Subsequently, after forming a hole portion to form the liquid supply port 5 using the aforementioned developing liquid, baking proper is performed on conditions of 200° C. and one hour. An opening area of the hole portion to form the liquid supply port 5 is set to be smaller than the area of the SiN film 29 to form the movable member 8.

Figure 13C:
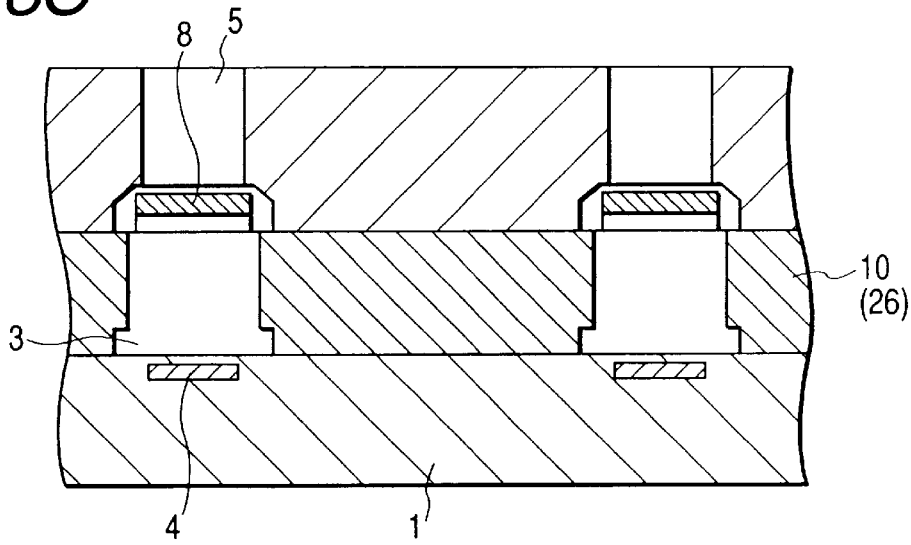

Finally, in FIG. 13C, mixture acid of acetic acid, phosphoric acid and nitric acid is used to heat/etch the Al films 25, 27, 28 and 30, these films are eluted and removed, and the liquid supply port 5, movable member 8, support member 9 and flow path side wall 10 are formed on the element substrate 1. Thereafter, hydrogen peroxide is used to remove portions corresponding to the heat generating member (bubble generating means) 4 and pad from the TiW film as the pad protective layer formed on the element substrate 1. The close abutment portion of the element substrate 1 and flow path side wall 10 also includes TiW as the constituting material of the pad protective layer, and Ta as the constituting material of the cavitation-resistant film of the element substrate 1.

By bonding the top plate 2 provided with the large-volume common liquid supply chamber 6 simultaneously communicating with the respective liquid supply ports 5 to the element substrate 1 with the movable member 8, flow path side wall 10 and liquid supply port 5 formed thereon as described above, the liquid discharge head was prepared as shown in FIGS. 1 to 3.

A modification example of the aforementioned head mode will next be described with reference to FIGS. 24A to 24D.

In the liquid discharge head of the mode shown in FIGS. 24A to 24D, the element substrate 1 is bonded to the top plate 2, and the liquid flow path 3 whose one end communicates with the discharge port 7 is formed between both plates 1 and 2.

Disposed in the liquid flow path 3 are the liquid supply port 5 and the common liquid supply chamber 6 which communicates with the liquid supply port 5.

Between the liquid supply port 5 and the liquid flow path 3, the movable member 8 is disposed substantially parallel to the opening area of the liquid supply port 5 with the slight gap a (e.g., 10 μm or less). The area surrounded with at least the free end portion of the movable member 8 and continued both side portions is larger than the opening area S to the liquid flow path of the liquid supply port 5, and the side portion of the movable member 8 has the slight gap β from the liquid flow path side wall 10. Thereby, the movable member 8 can move inside the liquid flow path 3 without any frictional resistance, while the displacement to the opening area side is restricted in the peripheral portion of the opening area S, and the liquid supply port 5 is substantially closed so that the liquid flow to the common liquid supply chamber 6 from the liquid flow path 3 can be prevented. Moreover, in the present embodiment, the movable member 8 is disposed opposite to the element substrate 1. Furthermore, one end of the movable member 8 is a free end displaced on the side of the heat generating member 4 of the element substrate 1, and the other end is supported by the support member 9.

(Second Embodiment)

In the aforementioned manufacture method, the manufacture process for disposing the movable member 8, flow path side wall 10 and liquid supply port 5 on the element substrate 1 has been described, but this is not limited, and a process of bonding the top plate 2 with the movable member 8 and liquid supply port 5 formed thereon beforehand to the element substrate 1 with the flow path side wall 10 formed thereon may be used.

One example of the manufacture process will be described hereinafter with reference to FIGS. 14A to 14D, 15A, 15B and 16. FIGS. 14A to 14D, 15A and 15B show the process by a surface cut along the direction crossing at right angles to the direction of the liquid flow path formed on the element substrate. FIG. 16 shows a sectional view of a schematic constitution of the liquid discharge head using the top plate prepared in FIGS. 14A to 14D, 15A and 15B. Moreover, in the description, the same reference numerals are used for the same constituting elements as those of the first embodiment.

Figure 14A:
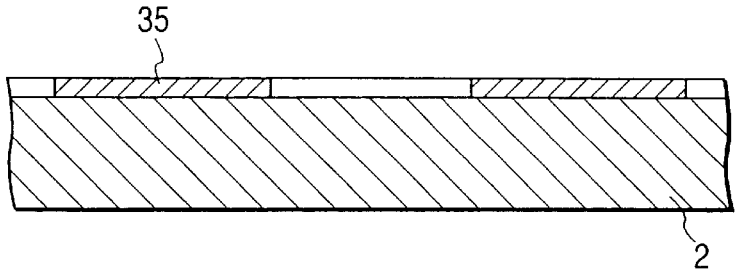
FIGS. 14A, 14B, 14C and 14D are explanatory views of the method of manufacturing the liquid discharge head according to a second embodiment of the present invention.
Figure 15A:
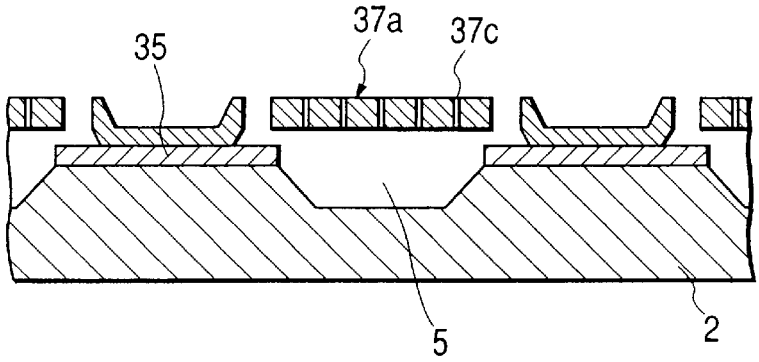
FIGS. 15A and 15B are explanatory views of the method of manufacturing the liquid discharge head according to the second embodiment of the present invention.

First, in FIG. 14A, an oxide film ($SiO_2$) 35 is formed in about 1.0 μm on one surface of the top plate 2 consisting of an Si material. Subsequently, the formed $SiO_2$ film 35 is patterned using the known photolithography process to remove the $SiO_2$ film corresponding to the forming place of the liquid supply port 5 shown in FIG. 16.

Figure 14B:
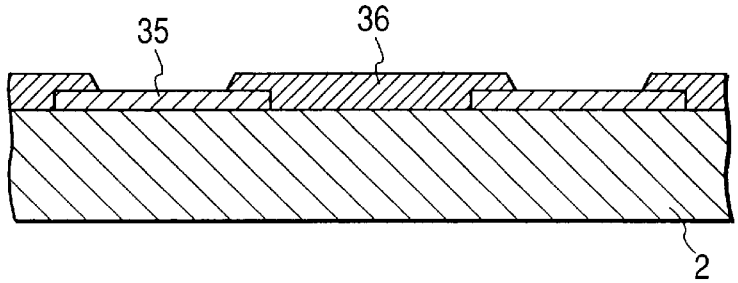

Next, in FIG. 14B, a gap forming member 36 consisting of the Al film is applied in about 3.0 μm to cover the removed portion of the $SiO_2$ film 35 in one surface of the top plate 2 and the peripheral portion. The gap forming member 36 is used to form the gap between the liquid supply port 5 and the movable member 8 formed in a process of FIG. 15B described later.

Figure 14C:
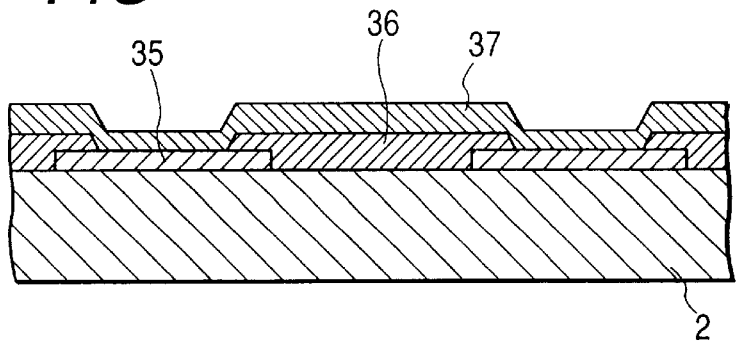

Subsequently, in FIG. 14C, on the entire surface of the $SiO_2$ film 35 and gap forming member 36, by using the plasma CVD method, an SiN film 37 with a thickness of about 3.0 μm as the material film for forming the movable member 8 is formed to cover the gap forming member 36.

Figure 14D:
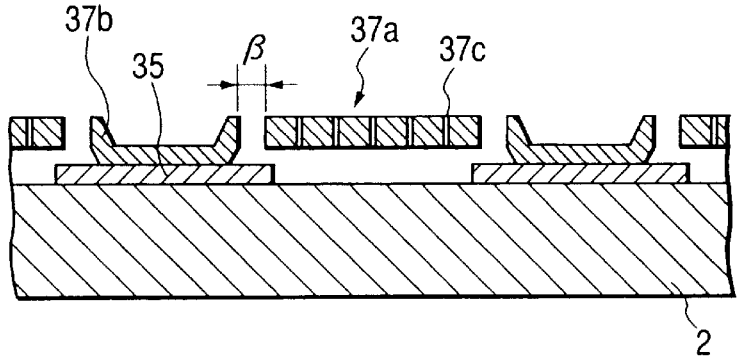

Subsequently, in FIG. 14D, with respect to the SiN film 37, the known photolithography process is used to pattern the movable member 8. Subsequently, the gap forming member is used as the etching stop layer to perform through etching on the Si top plate (thickness of 625 μm), and the common liquid supply chamber is formed. Thereafter, mixture acid of acetic acid, phosphoric acid and nitric acid is used to heat/etch the Al film as the gap forming member 36, and the film is eluted and removed. In the aforementioned patterning, 2 μm or more gap p is disposed between a movable portion 37*a* to form the movable member 8 and a support portion 37*b* in the SiN film 37. Furthermore, in the process of FIG. 15A described later, in order to easily form the liquid supply port 5 corresponding to the movable member 8, in the movable portion 37*a* in the SiN film 37 a plurality of slits 37*c* passed through the surface and back surface are formed preferably in 1 μm or less. Moreover, a projection area of the movable portion 37*a* is larger than the opening area (the removed area of the $SiO_2$ film 35) which forms the liquid supply port.

Subsequently, in FIG. 15A, on one surface of the Si top plate 2, the removed portion of the $SiO_2$ film 35 is subjected to anisotropic wet etching via the slit 37*c* of the movable portion 37*a*, and the liquid supply port 5 is formed.

Figure 15B:
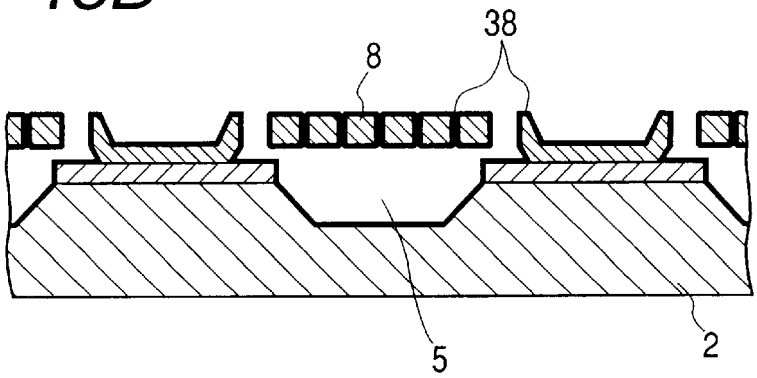
Figure 16:
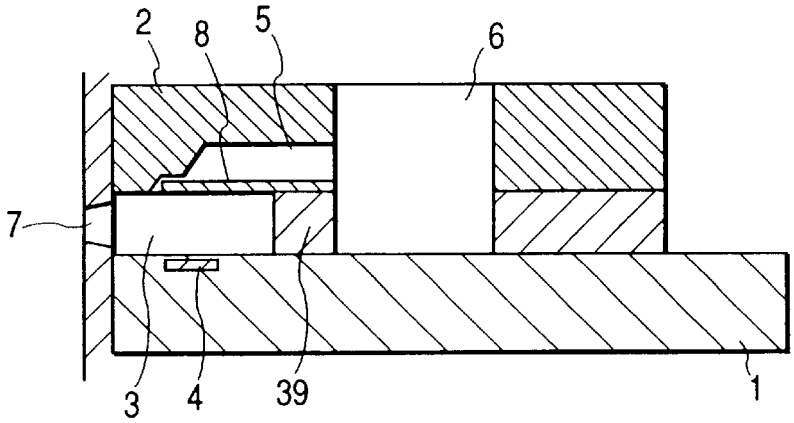
FIG. 16 is a sectional view schematically showing a constitution of the liquid discharge head according to the second embodiment of the present invention.

Finally in FIG. 15B, with respect to the material formed in the aforementioned processes, the LPCVD method is used to form an SiN film 38 with a thickness of about 0.5 μm, and the slit 37*c* opened in the movable member 8 is filled with the SiN film 38. In this case, the gap of the slit 37C is set to 1 μm or less, the slit 37*c* is closed, but the gap β between the movable portion 37*a* and the support portion 37*b* is set to 2 μm or more and the gap β therefore fails to be closed by the SiN film 38. Moreover, the silicon side wall formed by the anisotropic etching or the through etching of the silicon top plate is also coated with the SiN film by the LPCVD method, and corrosion by the ink is prevented.

By disposing the large-volume common liquid supply chamber 6 simultaneously communicating with the =respective liquid supply ports 5 on the side of the top plate 2 with the movable member 8 and liquid supply port 5 disposed thereon, and bonding the top plate to the element substrate 1 having a flow path wall for forming the liquid flow path 3 whose one end communicates with the discharge port 7 and whose other end is closed, the liquid discharge head shown in FIG. 16 was prepared. Even the liquid discharge head of this mode provides the similar effect to that of the liquid discharge head of the structure shown in FIGS. 1 to 3.

(Third Embodiment)

Figure 17:
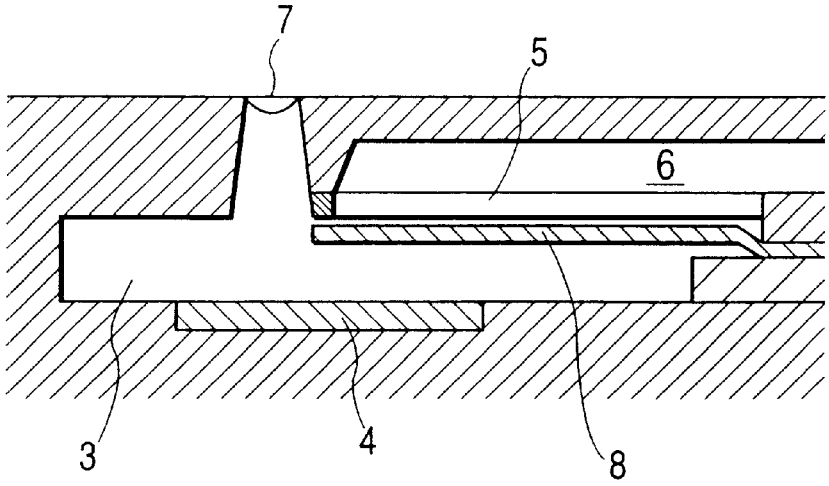
FIG. 17 is an explanatory view showing an example of a side shooter type head to which a liquid discharge method of the present invention is applied.

FIG. 17 is a sectional view of the liquid discharge head of a so-called side shooter type according to a third embodiment of the present invention. In the description, the same reference numerals are used for the same constituting elements as those of the first embodiment. The liquid discharge head of this mode is different from the first embodiment in that the heat generating member 4 faces the discharge port 7 on a parallel plane as shown in FIG. 17, and the liquid flow path 3 communicates at right angles with an axial direction along a discharge direction of the liquid from the discharge port 7. Even in this liquid discharge head, the effect is provided based on a discharge principle similar to that of the first embodiment, and the manufacture method described in the first and second embodiments can easily be applied.

(Other Embodiments)

Various mode examples preferable for the head using the aforementioned liquid discharge principle will be described hereinafter.

<Movable Member>

In the above embodiment, the material constituting the movable member is not limited as long as the material is provided with resistance to a solvent with respect to the discharge liquid, and with elasticity to satisfactorily operate as the movable member.

Examples of the material of the movable member preferably include: metals such as silver, nickel, gold, iron, titanium, aluminum, platinum, tantalum, stainless, and phosphor bronze and alloys of the metals; or resins with nitrile groups such as acrylonitrile, butadiene, and styrene, resins with amide groups such as polyamide, resins with carboxyl groups such as polycarbonate, resins with aldehyde groups such as polyacetal, resins with sulfone groups such as polysulfone, other resins such as liquid crystal polymer and compounds of the resins, highly ink-resistant metals such as gold, tungsten, tantalum, nickel, stainless and titanium, alloys of these metals and materials whose surfaces are coated with respect to resistance to ink; or resins with amide groups such as polyamide, resins with aldehyde groups such as polyacetal, resins with ketone groups such as polyether ether ketone, resins with imide groups such as polyimide, resins with hydroxyl groups such as phenol resin, resins with ethyl groups such as polyethylene, resins with alkyl groups such as polypropylene, resins with epoxy groups such as epoxy resin, resins with amino groups such as melamine resin, resins with methylol groups such as xylene resin and compounds of the resins; and further ceramics such as silicon dioxide and silicon nitride and compounds of the ceramics. The movable member in the present invention aims at a thickness of the order of micrometers.

An arrangement relation of the heat generating member and movable member will next be described. By the optimum arrangement of the heat generating member and movable member, the liquid flow during bubbling by the heat generating member is adequately controlled and can effectively be utilized.

Figure 18:
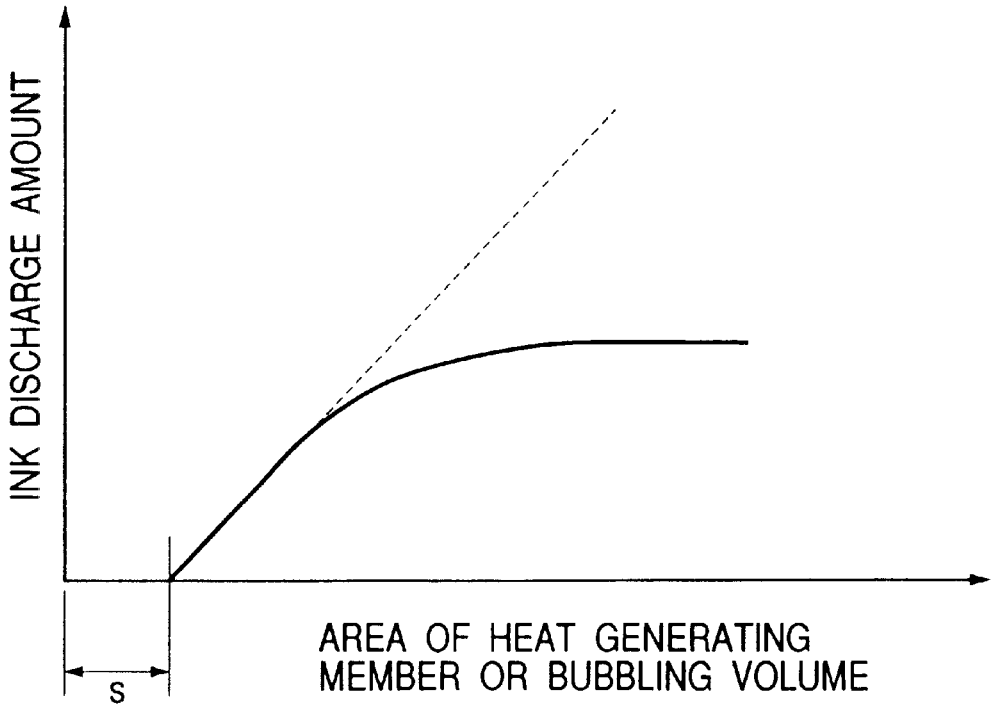
FIG. 18 is a graph showing a correlation between an area of the heat generating member and an ink discharge amount.

In the conventional art of an ink jet recording method of applying heat or another energy to the ink, causing a state change accompanied by a steep volume change (bubble generation) in the ink, discharging the ink from the discharge port by an action force based on the state change, and attaching the ink to a recording medium to form an image, a so-called bubble jet recording method, as shown by a broken line of FIG. 18, a heat generating member area is in a proportional relation with an ink discharge amount, but it is seen that there exists a non-bubbling effective area S which does not contribute to the ink discharge. Moreover, it is seen from a scorch state on the heat generating member that the non-bubbling effective area S exists around the heat generating member. These results show that a width of about 4 μm around the heat generating member does not participate in the bubbling. On the other hand, in the liquid discharge head of the present invention, the liquid flow path including the bubble generating means is substantially shielded excluding the discharge port so that the maximum discharge amount is regulated, as shown by a solid line of FIG. 18, there is an area in which the discharge amount fails to change even with large dispersions of the heat generating member area and bubbling volume, and the discharge amount of large dots can be stabilized by utilizing the area.

Furthermore, in order to satisfactorily form the aforementioned substantially sealed space, a distance between the movable member and the heat generating member in a standby state is preferably set to 10 μm or less.

<Element Substrate>

A constitution of the element substrate 1 provided with the heat generating member 4 for applying heat to the liquid will be described hereinafter.

Figure 19A:
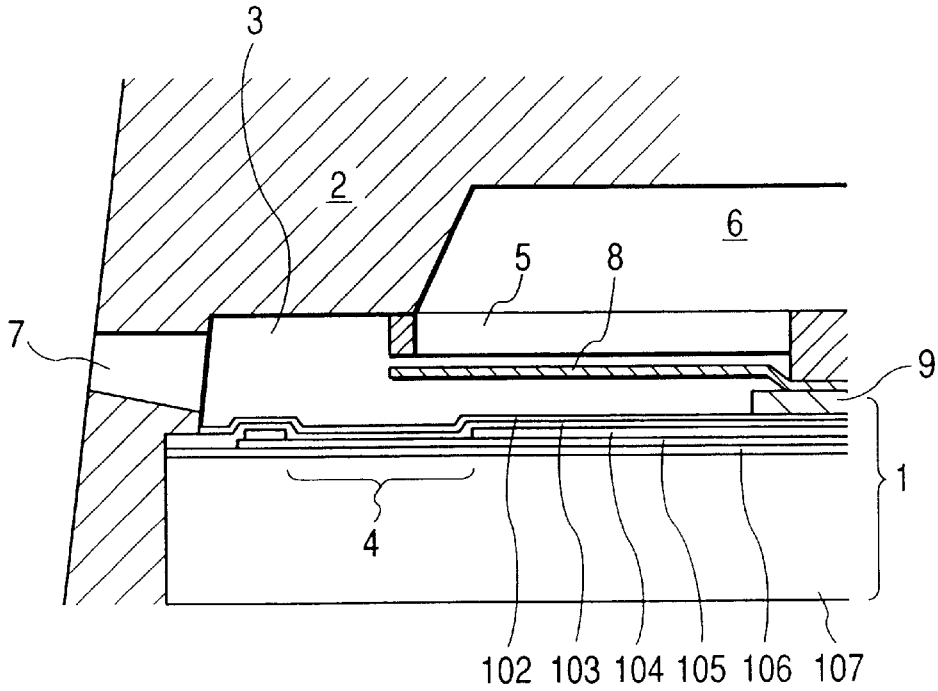
FIGS. 19A and 19B are longitudinal sectional views of the liquid discharge head of the present invention with a protective film and without the protective film, respectively.
Figure 19B:
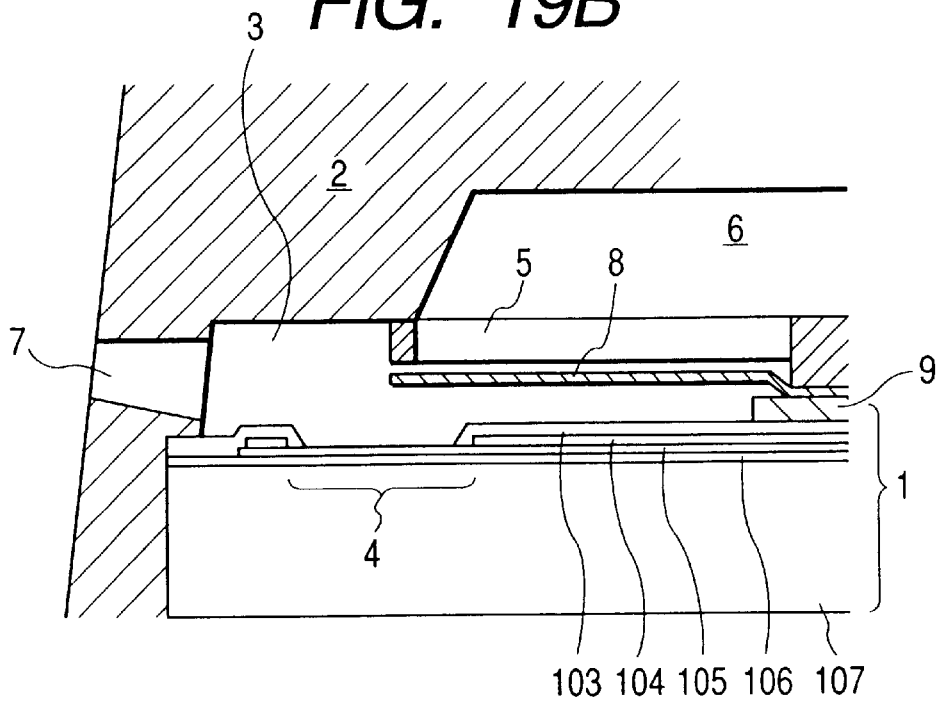

FIGS. 19A and 19B show side sectional views of a main part of a liquid discharge apparatus of the present invention, FIG. 19A shows the head with a protective film described later, and FIG. 19B shows the head without the protective film.

The top plate 2 is disposed on the element substrate 1, and the liquid flow path 3 is formed between the element substrate 1 and the top plate 2.

For the element substrate 1, a silicon oxide film or a silicon nitride film 106 for purposes of insulation and heat storage is formed on a substrate 107 of silicon or the like, and on the film an electric resistance layer 105 (thickness of 0.01 to 0.2 μm) of hafnium boride ($HfB_2$), tantalum nitride (TaN), tantalum aluminum (TaAl) or the like and a wiring electrode 104 (thickness of 0.2 to 1.0 μm) of aluminum or the like are patterned to constitute the heat generating member 4 as shown in FIG. 19A. By applying voltage to the resistance layer 105 from the wiring electrode 104 and passing current through the resistance layer 105, heat is generated. A protective film 103 of silicon oxide, silicon nitride or the like is formed with a thickness of 0.1 to 2.0 μm on the resistance layer 105 between the wiring electrodes 104, and further on the film a cavitation-resistant layer 102 of tantalum or the like (thickness of 0.1 to 0.6 μm) is formed, so that the resistance layer 105 is protected from various liquids such as the ink.

Particularly, pressures and impact waves generated during bubble generation and vanishing are so strong that durability of the hard and brittle oxide film is remarkably deteriorated, and therefore metal materials such as tantalum (Ta) are used as the cavitation-resistant layer 102.

Moreover, the aforementioned resistance layer 105 may require no protective film 103 by combination of the liquid, flow path constitution, and resistance material, and an example of such constitution is shown in FIG. 19B. As the material of the resistance layer 105 which requires no protective film 103, iridium-tantalum-aluminum alloy, and the like are exemplified.

As described above, the heat generating member 4 in the aforementioned respective embodiments may be constituted only of the resistance layer 105 (heat generator) between the electrodes 104, or may include the protective film 103 to protect the resistance layer 105.

In the respective embodiments, the heat generator constituted of the resistance layer 105 which generates heat in response to an electric signal is used as the heat generating member 4, but this is not limited, and the constitution may generate the bubble sufficient for discharging the discharge liquid in a bubbling liquid. For example, the heat generating member may comprise a photothermal converting element which receives laser or another light to generate the heat or a heat generator which receives a high frequency to generate the heat.

Additionally, for the element substrate 1, in addition to the heat generating member 4 including the resistance layer 105 constituting the aforementioned heat generator and the wiring electrode 104 for supplying the electric signal to the resistance layer 105, the function elements such as the transistor, diode, latch, and shift register for selectively driving the heat generating member 4 (electrothermal converting element) may integrally be formed by a semiconductor manufacture process.

Figure 20:
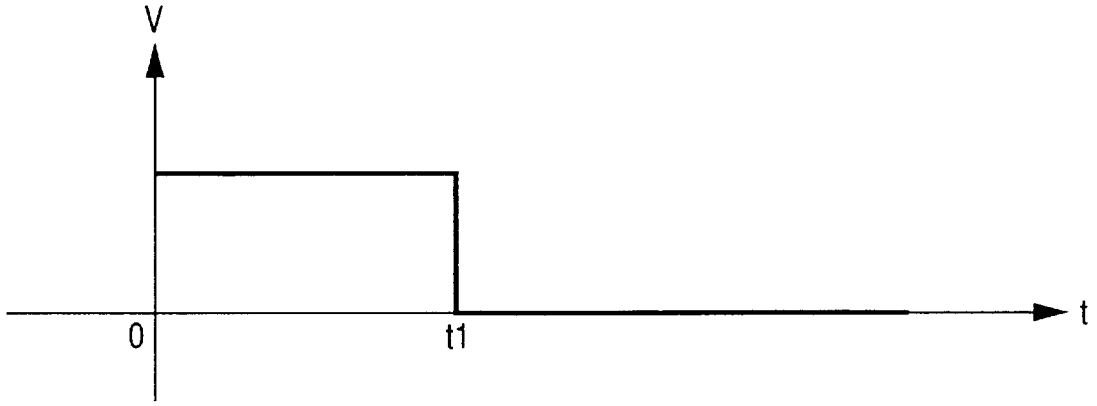
FIG. 20 is a chart of a waveform for driving the heat generating member for use in the present invention.

Moreover, in order to drive the heat generator of the heat generating member 4 disposed on the element substrate 1 as described above, and discharge the liquid, by applying a rectangular pulse to the resistance layer 105 via the wiring electrode 104 as shown in FIG. 20, the resistance layer 105 between the wiring electrodes 104 is steeply allowed to generate the heat. In the aforementioned head of the respective embodiments, by applying a voltage of 24V, pulse width of 7 μsec, current of 150 mA, and electric signal at 6 kHz to drive the heat generating member, the ink as the liquid is discharged from the discharge port 7 by the aforementioned operation. However, drive signal conditions are not limited to these, and a drive signal which can adequately bubble the bubbling liquid may be used.

<Discharge Liquid>

Among the liquids, the ink of the composition used in a conventional bubble jet apparatus can be used as the liquid for use in recording (recording liquid).

Additionally, as the property of the discharge liquid the discharge liquid itself desirably fails to inhibit the discharge, the bubbling, the operation of the movable member, or the like.

A highly viscous ink or the like can be utilized as the recording discharge liquid.

In the present invention, the ink of the following composition is used as the recording liquid which can be used in the discharge liquid and the recording is performed, but the ink discharge speed is raised by enhancement of the discharge force, and therefore reaching precision of liquid-droplet is enhanced so that a very satisfactory recorded image can be obtained.

TABLE 2

| Dye ink viscosity 2 cP | |
|---|---|
| (C.I. food black 2) dye | 3 wt % |
| diethyl glycol | 10 wt % |
| thiodiglycol | 5 wt % |
| ethanol | 3 wt % |
| water | 77 wt % |

<Liquid Discharge Apparatus>

Figure 21:
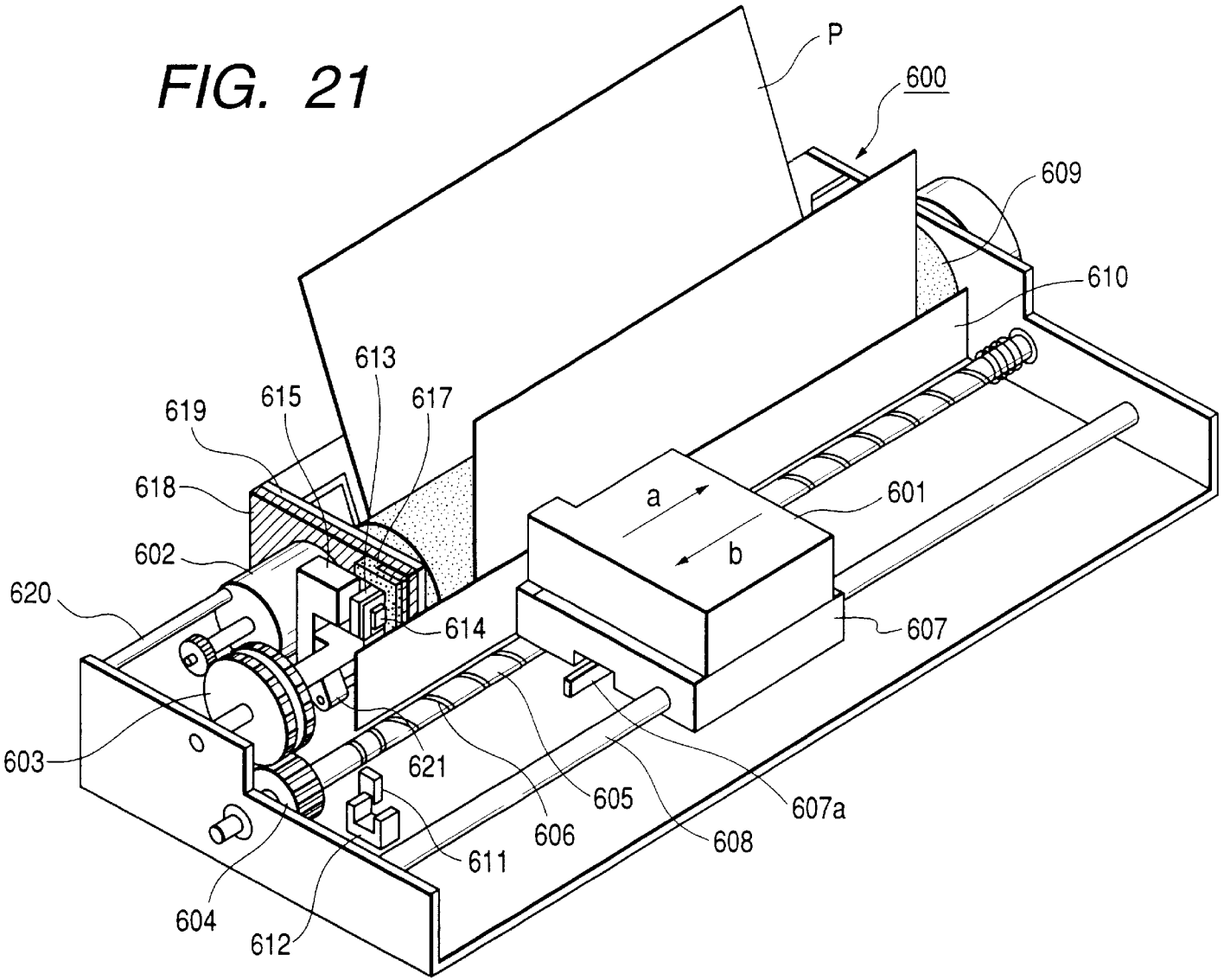
FIG. 21 is a schematic view showing a constitution of a liquid discharge apparatus on which the liquid discharge head of the present invention is mounted.

FIG. 21 schematically shows a constitution of an ink jet recording apparatus as one example of a liquid discharge apparatus on which the liquid discharge head of the structure described in the first to third embodiments can be mounted and applied. A head cartridge 601 mounted on an ink jet recording apparatus 600 shown in FIG. 21 includes the liquid discharge head of the aforementioned structure, and a liquid container for holding the liquid supplied to the liquid discharge head. As shown in FIG. 21, the head cartridge 601 is mounted on a carriage 607 which meshes with a helical groove 606 of a lead screw 605 rotating via drive force transmission gears 603 and 604 in cooperation with forward/backward rotation of a driving motor 602. By a power of the driving motor 602 the head cartridge 601 reciprocates/moves together with the carriage 607 along a guide 608 in directions of arrows a and b. The ink jet recording apparatus 600 is provided with recording medium conveying means (not shown) for conveying a printing sheet P as the recording medium which receives the ink or another liquid discharged from the head cartridge 601. A sheet press plate 610 of the printing sheet P conveyed on a platen 609 by the recording medium conveying means presses the printing sheet P onto the platen 609 over a moving direction of the carriage 607.

Photocouplers 611 and 612 are disposed in the vicinity of one end of the lead screw 605. The photocouplers 611 and 612 are home position detecting means for confirming the presence of a lever 607*a* of the carriage 607 in an area of the photocouplers 611 and 612 to switch a rotation direction of the driving motor 602. Disposed in the vicinity of one end of the platen 609 is a support member 613 for supporting a cap member 614 which covers a front surface provided with a discharge port of the head cartridge 601. Moreover, ink suction means 615 is disposed which sucks the ink stored inside the cap member 614 by empty discharge from the head cartridge 601. Suction recovery of the head cartridge 601 is performed via an opening of the cap member 614 by the ink suction means 615.

The ink jet recording apparatus 600 is provided with a main body support member 619. The main body support member 619 supports a moving member 618 so that the member can move in a forward/backward direction, that is, a direction extended at right angles to the moving direction of the carriage 607. A cleaning blade 617 is attached to the moving member 618. The cleaning blade 617 is not limited to this mode, and a known cleaning blade of another mode may be used. Furthermore, a lever 620 for starting the suction in a suction recovery operation by the ink suction means 615 is disposed, the lever 620 moves with movement of a cam 621 which meshes with the carriage 607, and a drive force from the driving motor 602 is controlled for the movement by known transmission means such as clutch switching. An ink jet recording controller for applying a signal to the heat generating member mounted on the head cartridge 601 or performing drive control of the aforementioned respective mechanisms is disposed on a recording apparatus main body side, and this is not shown in FIG. 21.

In the ink jet recording apparatus 600 provided with the aforementioned constitution, the head cartridge 601 reciprocates/moves over the entire width of the printing sheet P with respect to the printing sheet P conveyed on the platen 609 by the recording medium conveying means. When the drive signal is supplied to the head cartridge 601 from drive signal supply means (not shown) during the movement, in response to the signal the liquid discharge head portion discharges the ink (recording liquid) to the recording medium, and recording is performed.

Figure 22:
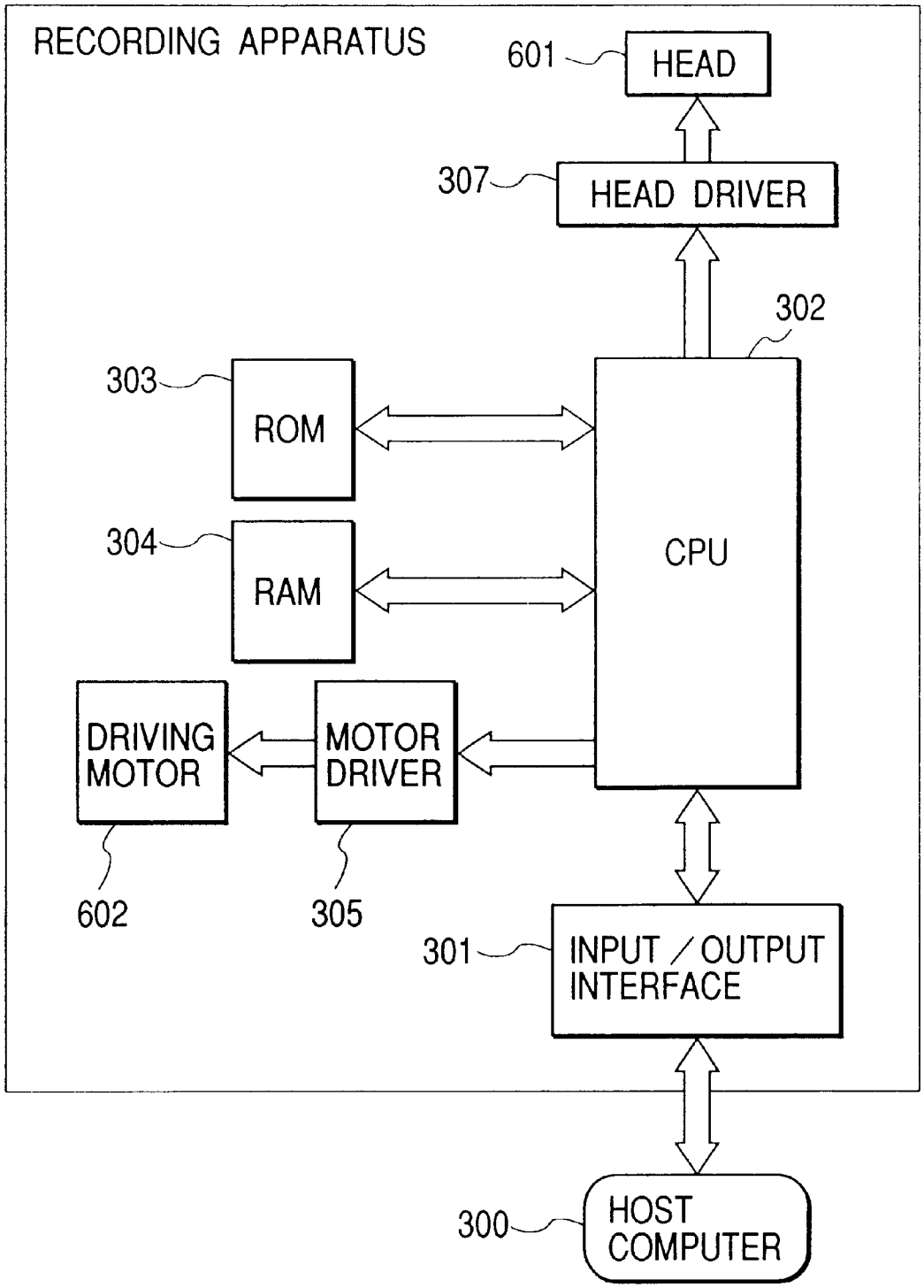
FIG. 22 is a block diagram of the entire apparatus for performing liquid discharge recording in the liquid discharge method and liquid discharge head of the present invention.
Figure 23:
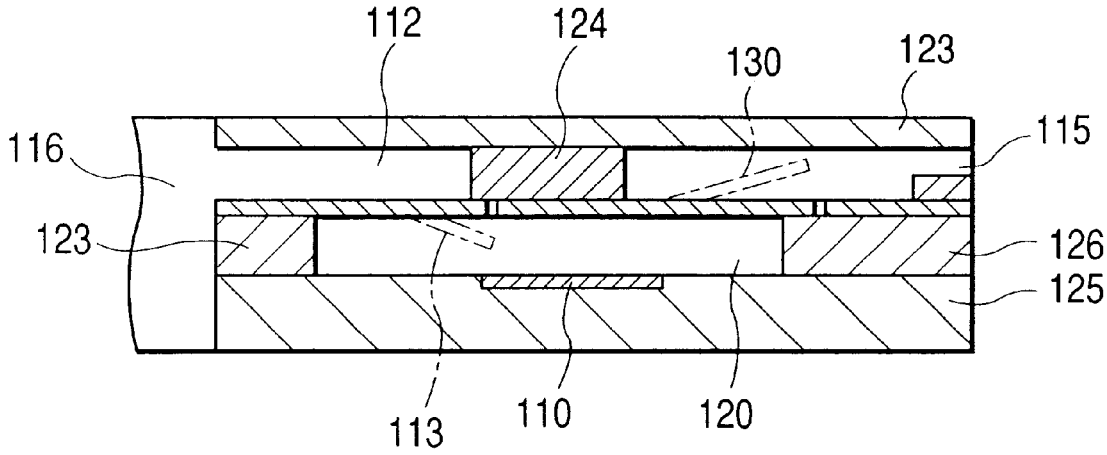
FIG. 23 is a sectional view showing a state of the movable member in a conventional liquid discharge head.
Figure 24D:
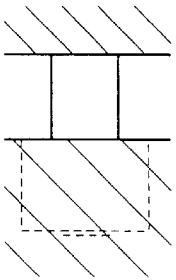
FIGS. 24A, 24B, 24C and 24D show a modification example of the liquid discharge head according to the first embodiment of the present invention.
Figure 24C:
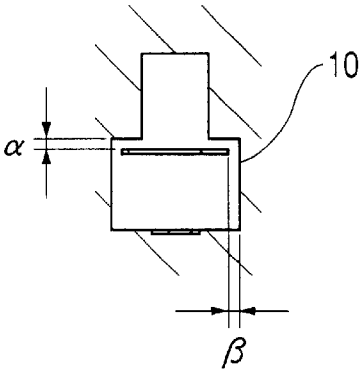
Figure 24A:
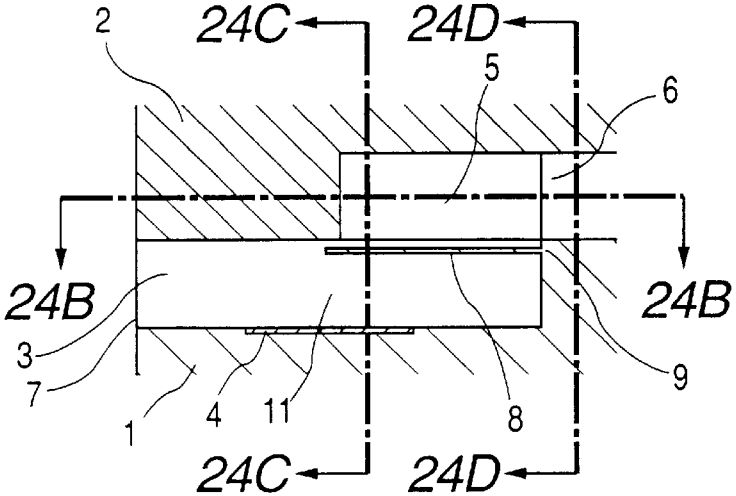
Figure 24B:
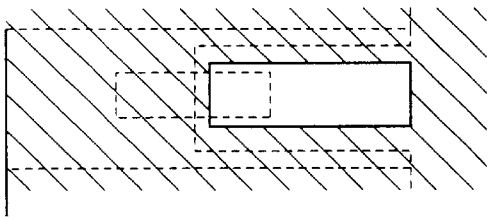

FIG. 22 is a block diagram of the entire recording apparatus for performing ink jet recording by the liquid discharge apparatus of the present invention.

The recording apparatus receives printing information as a control signal from a host computer 300. The printing information is temporarily stored in an input interface 301 inside a printing apparatus, converted to data which can be processed in the recording apparatus, and inputted to a central processing unit (CPU) 302 which also serves as head drive signal supply means. The CPU 302 uses peripheral units such as a random access memory (RAM) 304 to process the data inputted to the CPU 302 based on a control program stored in a read only memory (ROM) 303, and converts the data to data to be printed (image data).

Moreover, in order to record the image data to an appropriate position on the recording sheet, the CPU 302 prepares drive data for driving the driving motor 602 to move the recording sheet and the carriage 607 with the head cartridge 601 mounted thereon in synchronization with the image data. The image data and the motor drive data are transmitted to the head cartridge 601 and the driving motor 602 via a head driver 307 and a motor driver 305, respectively, and the motor is driven at a controlled timing to form an image.

As the recording medium 150 which is used in the recording apparatus and to which the liquid such as the ink is applied, various papers or OHP sheets, plastic materials for use in a compact disk, decorating plate, and the like, cloth, metal materials such as aluminum and copper, leathers such as ox/cow hide, pigskin and artificial leather, wood materials such as wood and plywood, bamboo materials, ceramic materials such as tiles, three-dimensional structure materials such as sponge, and the like can be used.

Moreover, the recording apparatus includes a printer apparatus for performing recording on various papers, OHP sheets, and the like, a plastic recording apparatus for performing recording on the plastic materials such as the compact disk, a metal recording apparatus for performing recording on a metal plate, a leather recording apparatus for performing recording on the leather, a wood material recording apparatus for performing recording on the wood material, a ceramic recording apparatus for performing recording on the ceramic material, a recording apparatus for performing recording on the three-dimensional net structure materials such as the sponge, a textile printing apparatus for performing recording on the cloth, and the like.

Moreover, as the discharge liquid for use in the liquid discharge apparatus, liquids adapted to recording media and recording conditions may be used.

Effect of the Invention

As described above, in the present invention, by the constitution in which in the period of the substantially isotropic growth of the bubble in the initial stage of the bubble generation by the bubble generating means, the communication state between the liquid flow path and the liquid supply port is immediately shut off by the movable member, and the inside of the liquid flow path is substantially placed in the sealed state excluding the discharge port, and most of the pressure wave by the bubble growth in the bubble generating area is directed to the discharge port side without being propagated to the liquid supply port or the common liquid supply chamber, so that the discharge power can rapidly be enhanced. Moreover, even when the highly viscous recording liquid is used in order to fix the liquid to the recording sheet or the like at a high speed or to remove blur in the boundary of black and another color, the highly viscous ink can satisfactorily be discharged by rapid enhancement of the discharge power. Moreover, the ink thickening area increases in the discharge port with the environmental change during recording, particularly under an environment with low temperature and low humidity, and the ink is not normally discharged at the start of use, but in the present invention the ink can satisfactorily be discharged from first. Moreover, since the discharge power is rapidly enhanced, it is possible to reduce the size of the heat generating member for use as the bubble generating means and to reduce the energy to be projected for the discharge.

Moreover, with bubble shrinkage the movable member is displaced toward the bubble generating means, and the liquid rapidly flows as a large flow into the liquid flow path from the common liquid supply chamber via the liquid supply port. Thereby, since the flow for quickly drawing the meniscus M into the liquid flow path rapidly decreases, the retreat amount of the meniscus decreases in the discharge port after liquid droplet discharge. As a result, time for returning the meniscus to the initial state after the discharge is very short, that is, time for completing refilling of a fixed amount of ink to the liquid flow path is short, so that even the discharge frequency (drive frequency) can also rapidly be enhanced in performing the high-precision (fixed amount) ink discharge.

What is claimed is:

1. A liquid discharging method utilizing a liquid discharge head comprising:

a plurality of discharge ports for discharging a liquid, a plurality of liquid flow paths each communicating respectively with each of the discharge ports and which comprise a bubble generating area for generating a bubble in the liquid, bubble generating means for generating energy to generate and grow the bubble, a plurality of liquid supply ports, disposed in the plurality of liquid flow paths, respectively, for communicating with a common liquid supply chamber, and a movable member provided in at least one of said liquid flow paths and having a free end supported with a slight gap with respect to a liquid flow path side of the respective liquid supply port, wherein an area encompassed by at least a free end portion of the movable member and both side portions of the movable member continued from the free end portion is larger than an opening area to the respective liquid flow path of the respective liquid supply port, said method comprising the steps of:

applying a drive voltage to the bubble generating means;

generating a bubble on the bubble generating means;

substantially shutting the opening area by tightly closing the movable member;

starting retraction of the bubble;

starting supply of the liquid into the respective liquid flow path from the common liquid supply chamber while the movable member is displaced to a bubble generating means side, as a meniscus is retracted into the respective liquid flow path;

discharging the liquid from the discharge port as a liquid droplet having a volume Vd;

causing a retracted amount of the meniscus to have a maximum value Vm smaller than Vd;

causing the bubble to disappear while the retracted amount of the meniscus is the maximum value Vm; and causing the meniscus to be stable at a position before the drive voltage is applied to the bubble generating means.

2. The liquid discharging method according to claim 1, wherein a gap is provided between the movable member and a liquid path wall to form the liquid flow path.

3. The liquid discharging method according to claim 1, wherein the discharge port and the bubble generating means are in a state of linear communication.

* * * * *